US010035627B2

(12) United States Patent
Glaser et al.

(10) Patent No.: US 10,035,627 B2
(45) Date of Patent: Jul. 31, 2018

(54) TAMPER-EVIDENT CLOSURE ASSEMBLY INCLUDING OUTER SHELL, AND RELATED SYSTEMS AND METHODS

(71) Applicant: Fisher Scientific Company, L.L.C., Fair Lawn, NJ (US)

(72) Inventors: John T. Glaser, Clifton Park, NY (US); Jonathan David Assaraf, New York, NY (US); Jack A. Rodriguez, Montmorency (FR)

(73) Assignee: Fisher Scientific Company, L.L.C., Fair Lawn, NJ (US)

( * ) Notice: Subject to any disclaimer, the term of this patent is extended or adjusted under 35 U.S.C. 154(b) by 107 days.

(21) Appl. No.: 15/316,582

(22) PCT Filed: Jun. 5, 2015

(86) PCT No.: PCT/US2015/034401

§ 371 (c)(1),
(2) Date: Dec. 6, 2016

(87) PCT Pub. No.: WO2015/188057

PCT Pub. Date: Dec. 10, 2015

(65) Prior Publication Data

US 2017/0225843 A1 Aug. 10, 2017

Related U.S. Application Data

(63) Continuation-in-part of application No. 14/298,365, filed on Jun. 6, 2014, now Pat. No. 9,586,730.
(Continued)

(51) Int. Cl.
*B65D 55/02* (2006.01)
*B65D 41/34* (2006.01)
(Continued)

(52) U.S. Cl.
CPC ..... *B65D 41/34* (2013.01); *B65D 21/02* (2013.01); *B65D 41/04* (2013.01); *B65D 51/18* (2013.01)

(58) Field of Classification Search
CPC ..... B65D 2251/0015; B65D 51/18; B65D 41/62; B65D 50/067; B65D 2101/0046; Y10S 215/901; Y10S 215/03; A61J 1/05
(Continued)

(56) References Cited

U.S. PATENT DOCUMENTS 1,981,414 A 11/1934 Hermani
2,077,027 A 4/1937 Torras
(Continued)

FOREIGN PATENT DOCUMENTS

EP 133348 A1 2/1985
EP 209356 A2 1/1987
(Continued)

OTHER PUBLICATIONS

The International Bureau of WIPO, International Preliminary Report on Patentability and Written Opinion of the International Searching Authority, International Application No. PCT/US2015/034401, dated Dec. 15, 2016 (8 pages).
(Continued)

*Primary Examiner* — Shawn M Braden
(74) *Attorney, Agent, or Firm* — Wood Herron & Evans LLP

(57) ABSTRACT

A tamper-evident closure assembly for a container having an opening includes a cap configured to be secured with the container to cover the opening. A tamper-evidencing member is carried by the cap and is configured to provide an indication when the cap is removed from the container. The closure assembly further includes an outer shell having a central aperture through which the cap is received. The outer
(Continued)

shell and the cap may be configured to cooperate with each other such that the cap is operatively secured to, and mounted so as to be non-rotatable relative to, the outer shell. Systems for storing material and methods of closing a container and assembling a closure assembly are also provided.

11 Claims, 20 Drawing Sheets

Related U.S. Application Data

(60) Provisional application No. 62/008,862, filed on Jun. 6, 2014.

(51) Int. Cl.
*B65D 41/04* (2006.01)
*B65D 51/18* (2006.01)
*B65D 21/02* (2006.01)

(58) Field of Classification Search
USPC ..... 215/251–253, 258
See application file for complete search history.

(56) References Cited

U.S. PATENT DOCUMENTS

| | | | | | |
|---|---|---|---|---|---|
| 3,923,182 | A * | 12/1975 | Choksi | B65D 50/067 215/250 |
| 3,923,183 | A | 12/1975 | Choksi et al. | |
| 3,923,184 | A | 12/1975 | Choksi et al. | |
| 3,923,185 | A * | 12/1975 | Choksi | B65D 50/067 215/253 |
| 4,091,949 | A * | 5/1978 | Fowles | B65D 41/62 215/232 |
| 4,441,620 | A | 4/1984 | Tune | |
| 4,726,483 | A | 2/1988 | Drozd | |
| 4,778,070 | A * | 10/1988 | Walker | B65D 55/10 215/232 |
| 6,050,436 | A * | 4/2000 | Bennett | B65D 41/3428 215/251 |
| 6,234,334 | B1 | 5/2001 | Suarez | |
| 7,337,921 | B2 | 3/2008 | Ma | |
| 7,527,161 | B2 | 5/2009 | Rodriguez et al. | |
| 8,281,944 | B2 | 10/2012 | Battegazzore | |
| 8,291,944 | B2 * | 10/2012 | Allidieres | F17C 5/007 137/565.16 |
| 8,292,103 | B2 | 10/2012 | Weist | |
| 8,652,423 | B2 | 2/2014 | Shick | |
| 2001/0020607 | A1 | 9/2001 | Chiarin | |
| 2007/0102392 | A1 | 5/2007 | Hoepner et al. | |
| 2008/0023502 | A1 | 1/2008 | Knes | |
| 2008/0142473 | A1 | 6/2008 | Cho | |
| 2008/0169261 | A1 | 7/2008 | Druitt et al. | |
| 2010/0038279 | A1 | 2/2010 | Estep | |
| 2012/0205338 | A1 | 8/2012 | Cheng | |
| 2013/0240530 | A1 | 9/2013 | Glaser et al. | |
| 2013/0245592 | A1 | 9/2013 | Glaser et al. | |
| 2015/0001108 | A1 | 1/2015 | Lee et al. | |
| 2015/0251819 | A1 | 9/2015 | Glaser et al. | |
| 2015/0251820 | A1 * | 9/2015 | Glaser | B65D 41/34 220/265 |

FOREIGN PATENT DOCUMENTS

| | | | |
|---|---|---|---|
| EP | 515260 | A1 | 11/1992 |
| EP | 1499535 | A1 | 1/2005 |
| GB | 2172273 | A | 9/1986 |
| GB | 2430667 | A | 4/2007 |
| WO | 2009100274 | A1 | 8/2009 |

OTHER PUBLICATIONS

European Patent Office, European Search Report in EP Application No. 15153579.6, dated Jul. 24, 2015 (8 pages).

International Searching Authority, International Search Report and Written Opinion, International Application No. PCT/US2015/034401, dated Jul. 13, 2015 (11 pages).

U.S. Patent Office, Final Office Action in corresponding U.S. Appl. No. 14/298,365, dated Mar. 30, 2016 (9 pages).

U.S. Patent Office, Office Action in corresponding U.S. Appl. No. 14/298,365, dated Oct. 21, 2015 ( pages).

* cited by examiner

TAMPER-EVIDENT CLOSURE ASSEMBLY INCLUDING OUTER SHELL, AND RELATED SYSTEMS AND METHODS

CROSS-REFERENCE TO RELATED APPLICATIONS

The present application claims priority under 35 U.S.C. § 371 of International Application No. PCT/US2015/034401, filed Jun. 5, 2015, which claims the filing benefit of U.S. Provisional Patent Application Ser. No. 62/008,862, filed Jun. 6, 2014, and is a continuation-in-part of U.S. patent application Ser. No. 14/298,365, filed Jun. 6, 2014, now U.S. Pat. No. 9,586,730, each disclosure of which is hereby incorporated by reference herein in its entirety.

FIELD OF THE INVENTION

The present invention relates generally to closure assemblies for closing containers having openings and, more particularly, to closure assemblies including a tamper evident feature.

BACKGROUND OF THE INVENTION

Caps and closure assemblies, such as closure assemblies including caps, are often used to close containers having openings. Such containers may be used to store particulate materials or liquids, for example. By closing the opening of the container, the contents held therein may be confined within the container and prevented from escaping through the opening.

In applications where it is important to ensure the integrity of the contents within a container, tamper-evident features have been used to indicate whether or not a cap or closure assembly has been removed from the container. For example the cap or closure assembly may break a frangible connection upon a first opening to indicate visually at all times thereafter that the cap or closure assembly has been opened at least once.

However, there remains a need for improvements in the area of caps and closure assemblies having tamper-evident features.

SUMMARY OF THE INVENTION

The present invention provides improvements to overcome shortcomings of known caps and closure assemblies. While the invention will be described in connection with several embodiments, it will be understood that the invention is not limited to these embodiments. On the contrary, the invention includes all alternatives, modifications, and equivalents as may be included within the scope of the present invention.

A tamper-evident closure assembly for a container having an opening is provided. In one embodiment, the closure assembly includes a cap configured to be secured to the container to cover the opening. The closure assembly further includes a tamper-evidencing member carried by the cap and configured to provide an indication when the cap is removed from the container. The closure assembly further includes an outer shell having a central aperture through which the cap is received. The outer shell and the cap may be configured to cooperate with each other such that the cap is operatively secured to, and mounted so as to be non-rotatable relative to, the outer shell.

A system for storing material is also provided. In one embodiment, the system includes a plurality of containers, each container having an opening and being fitted with a tamper-evident closure assembly. Each tamper-evident closure assembly includes a cap secured with the container to cover the opening, a tamper-evidencing member carried by the cap and configured to provide an indication when the cap is removed from the container, and an outer shell having a central aperture through which the cap is received. The cap is operatively secured to, and mounted so as to be non-rotatable relative to, the outer shell. Each of the containers includes a bottom wall having a cavity. The plurality of containers and their corresponding tamper-evident closure assemblies are configured to be stacked one on top of another such that a top portion of the cap secured to a lower one of the containers is received within the cavity on the bottom wall of an adjacent upper one of the containers.

A method of closing a container having an opening is also provided. In one embodiment, the method includes positioning an outer shell about a cap and a tamper-evidencing member carried by the cap. The method further includes operatively securing the cap to the outer shell such that the cap is received within a central aperture of the outer shell and is mounted so as to be non-rotatable relative to the outer shell. The method further includes positioning the cap, the tamper-evidencing member, and the outer shell in alignment with the container opening. The method further includes securing the cap to the container to cover the opening.

A method of assembling a closure assembly configured for use with a container is also provided. In one embodiment, the method includes providing a cap and a tamper-evidencing member carried by the cap. The cap is configured to be secured to the container and the tamper-evidencing member is configured to provide an indication when the cap is removed from the container. The method further includes providing an outer shell having a central aperture, and positioning the cap coaxially with the outer shell. The method further includes operatively securing the outer shell to the cap such that the cap is received through the central aperture and is non-rotatable relative to the outer shell.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION OF THE INVENTION

Figure 1:
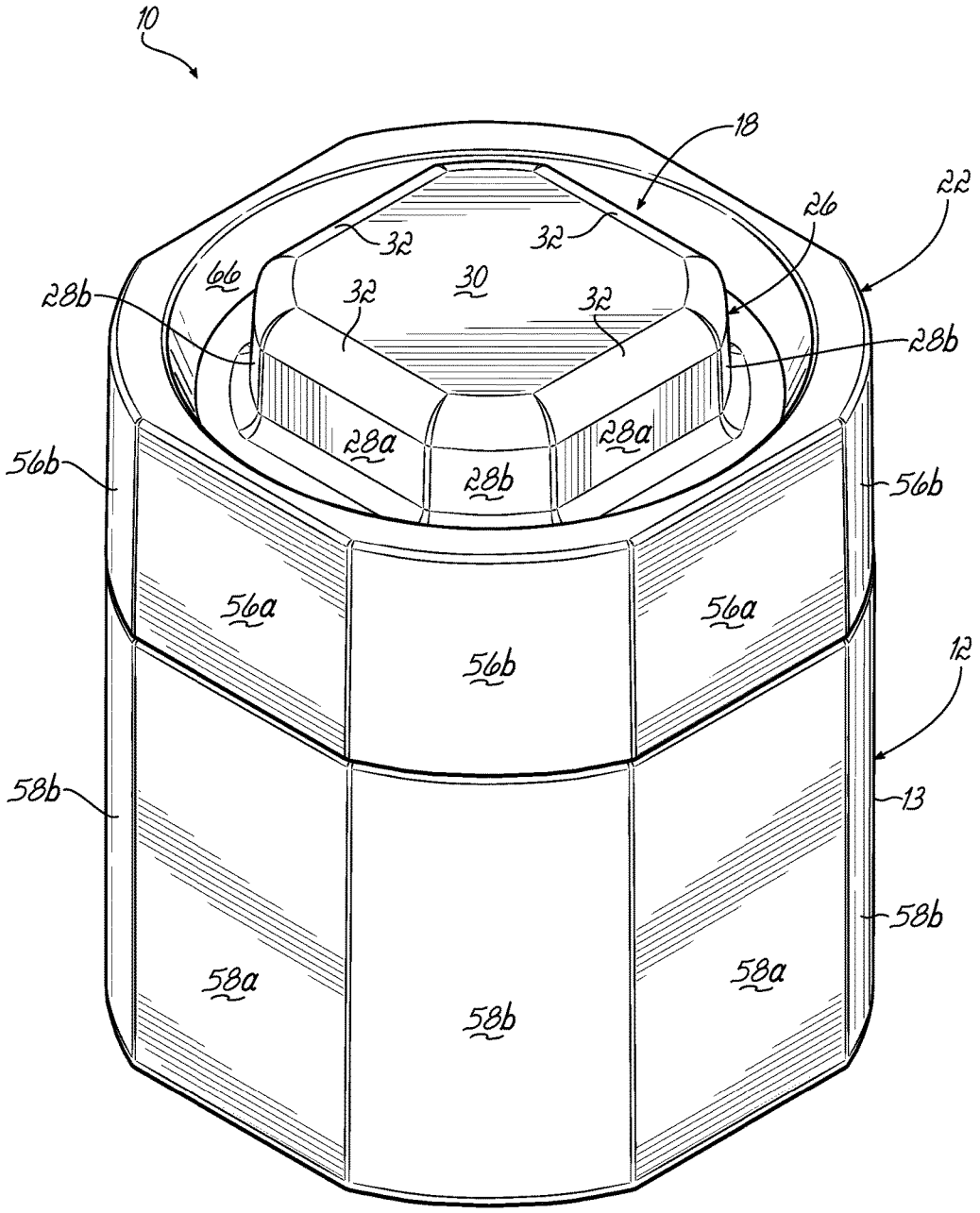
FIG. 1 is an isometric view showing a tamper-evident closure assembly in combination with a container according to an embodiment of the present invention, with the tamper-evident enclosure assembly including a cap carrying a tamper-evidencing member and an outer shell through which the cap is received.
Figure 2:
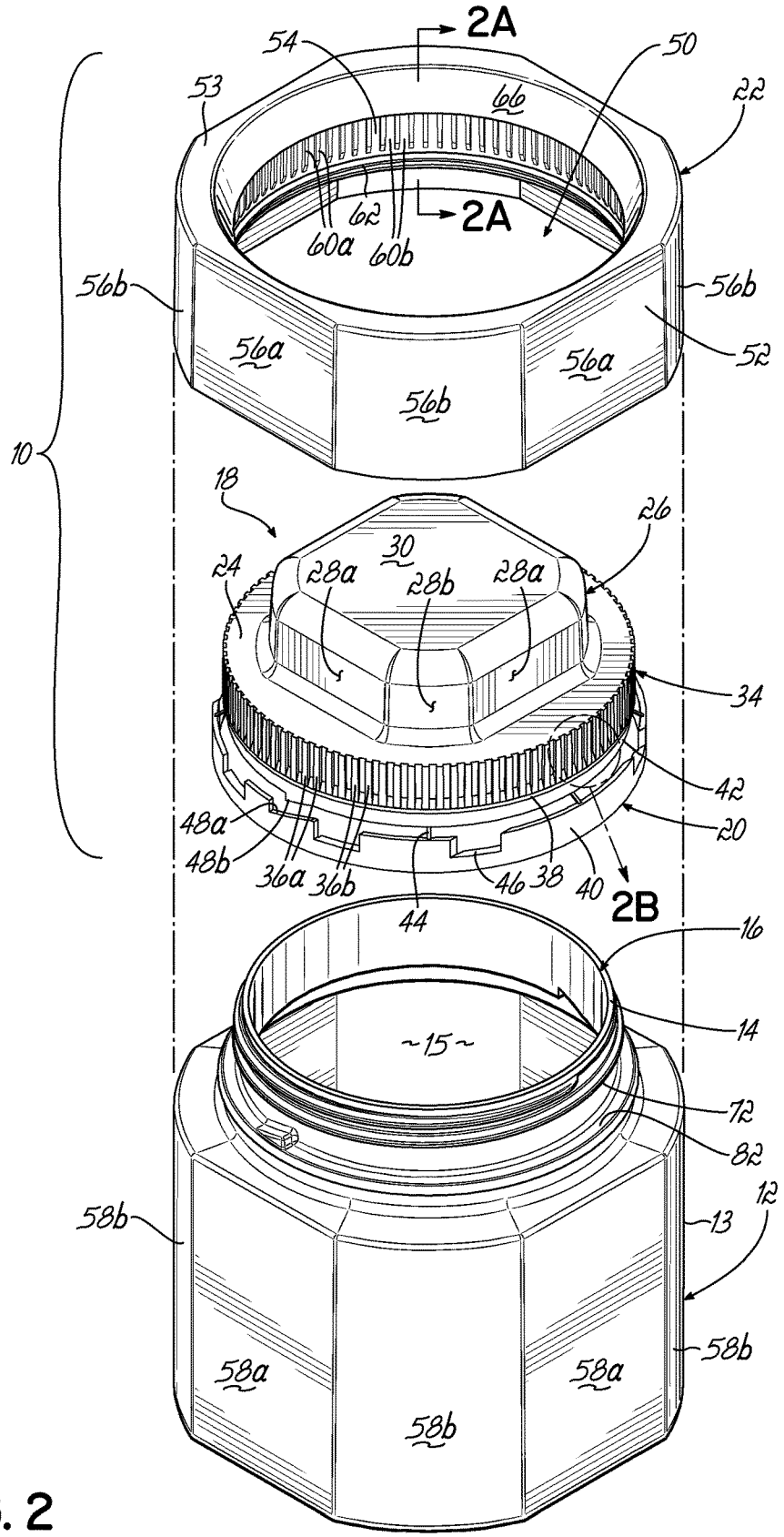
FIG. 2 is an isometric partially disassembled view showing the tamper-evident closure assembly and container of FIG. 1.
Figure 3:
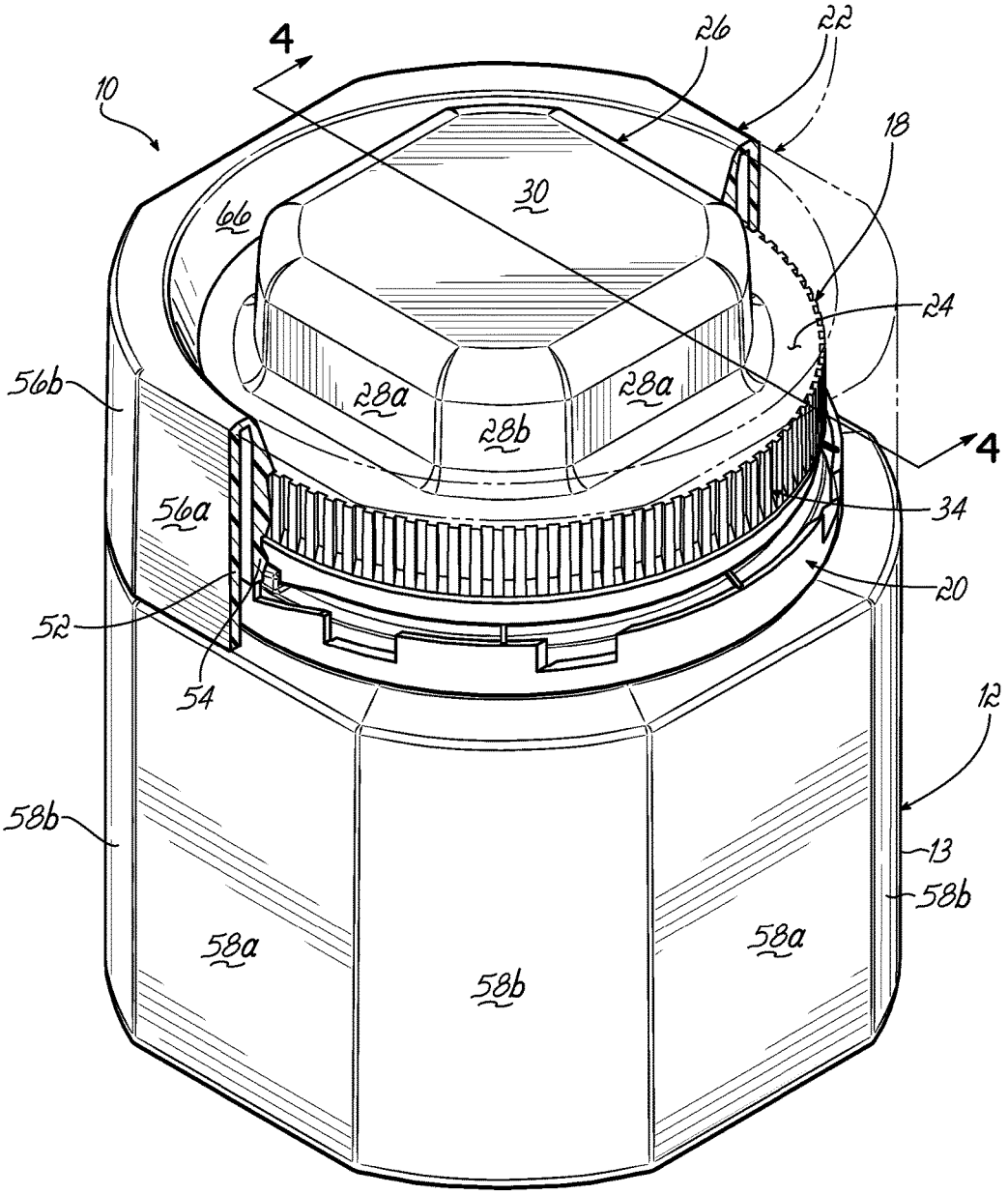
FIG. 3 is a view similar to FIG. 1, but where the outer shell is shown partially broken away.

Referring now to the figures, and to FIGS. 1-3 in particular, a tamper-evident closure assembly 10 and a container 12 according to a first exemplary embodiment of the present invention are shown. The container 12 has a body 13 defining an inner cavity 15, and a neck 14 extending upwardly from the body 13 and defining a circular opening 16 that communicates with the inner cavity 15. As shown, the closure assembly 10 may be secured to the container 12 to close or essentially seal the opening 16, thereby containing within the container 12 a material (not shown) such as a particulate, for example. The closure assembly 10 includes a cap 18, a tamper-evidencing member 20 carried by the cap 18, and an outer shell 22 that may be positioned about and operatively secured to the cap 18 such that the cap 18 is non-rotatable relative to the outer shell 22.

In the illustrated embodiment, the cap 18 includes a top wall 24 and a boss 26 projecting upwardly from the top wall 24. The boss 26 may be generally polygonally shaped. For example, as shown, the boss 26 may be generally octagonal and include a set of eight side faces, four of which are generally planar side faces 28*a* and four of which are generally curved side faces 28*b*. Each of the curved side faces 28*b* may be positioned between an adjacent set of planar side faces 28*a*. The boss 26 may also include a generally planar top surface 30 and rounded top edges 32.

An annular skirt wall 34 depends axially downward from the cap top wall 24 and may include a plurality of uniformly spaced axial ribs 36*a* projecting radially outward and defining a corresponding plurality of axial grooves 36*b* between each pair of adjacent ribs 36*a*. An outwardly projecting annular bead 38 may be provided on a bottom portion of the skirt wall 34 adjacent to the axial ribs 36*a*, as shown in FIG. 2B, and may extend circumferentially about the skirt wall 34. While the annular bead 38 is shown as a continuous structure, it will be appreciated that, alternatively, the annular bead 38 may be discontinuous. As will be described in greater detail below, the annular bead 38 may operate to secure the cap 18 to the outer shell 22.

The tamper-evidencing member 20 carried by the cap 18 is configured to provide an indication when the cap 18 is removed from the container 12, as described in greater detail below. In one embodiment, as shown, the tamper-evidencing member 20 includes a tamper-evident band 40 frangibly connected to a lower rim 42 of the cap 18. In particular, the frangible connection between the band 40 and cap 18 is provided by a plurality of frangible, slender webs 44.

As described below, the band 40 is configured to be retained on the neck 14 of the container 12, and the slender webs 44 forming the frangible connection are configured to break upon a first removal of the cap 18 from the neck 14, such that the cap 18 separates from the band 40. Thereby, it is evident to a user that the cap 18 has been removed at least once from the container 12.

Figure 4:
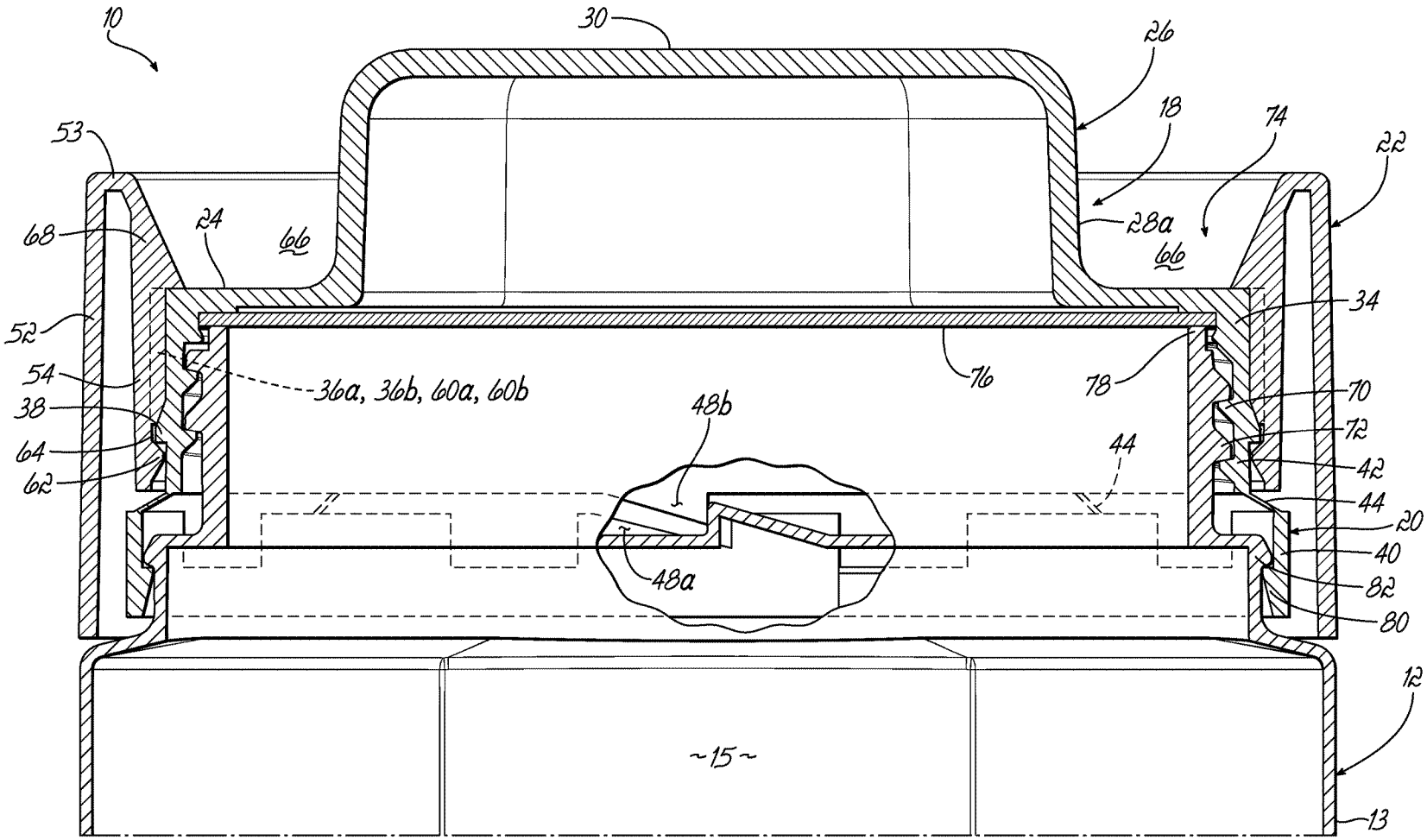
FIG. 4 is a cross-sectional view taken generally along section line 4-4 of FIG. 3, showing the tamper-evident closure assembly and container.

Furthermore, as shown, the band 40 may be formed with one or more notches 46 spaced circumferentially, for example to conserve material during manufacture. As shown in FIG. 2, the band 40 may further include a stop element 48*a* configured to receive and engage a corresponding abutment element 48*b* provided on the lower rim 42 of the cap 18. In particular, the stop element 48*a* may engage the abutment element 48*b* when the cap 18 is threaded onto the neck 14 of the container 12. Thereby, rotational forces exerted on the cap 18 during assembly may be transferred to the band 40 through the engagement of the elements 48*a*, 48*b* rather than through the slender webs 44. Consequently, unintended fatigue or failure of the slender webs 44 may be avoided. Also, as shown in FIG. 4, a stop element 48*a* may also be provided on the lower rim 42 of the cap 18 and a corresponding abutment element 48*b* may also be provided on the band 40.

In the illustrated embodiment, the outer shell 22 includes a central aperture 50 through which the cap 18 is received for operatively securing the cap 18 to the outer shell 22. The outer shell 22 may include an outer annular wall 52 defining an outer periphery of the outer shell 22, and an inner annular wall 54 defining the central aperture 50. The outer and inner annular walls 52, 54 may be joined together by a web-like upper wall 53. Additionally, the outer shell 22 may be generally polygonally shaped. In particular, the outer shell 22 may be generally octagonal so as to correspond in size and shape to a generally octagonal outer periphery defined by the body 13 of the container 12. In this regard, the outer periphery of outer shell 22 may include a set of eight faces, four of which are generally planar side faces 56*a* and four of which are generally curved side faces 56*b*. Each of the curved side faces 56*b* may be positioned between an adjacent set of planar side faces 56*a*.

As best shown in FIG. 1, the body 13 of the container 12 may include similarly patterned sets of generally planar side faces 58*a* and generally curved side faces 58*b*. When the outer shell 22 is engaged with the cap 18, which in turn is secured to the container 12, the outer periphery of the outer shell 22 may substantially correspond in size and shape with the outer periphery of the container body 13, such as the radially outermost or maximum periphery. In particular, the planar side faces 56*a* of the outer shell 22 may be aligned with corresponding planar side faces 58*a* of the container body 13, and the curved side faces 56*b* of the outer shell 22 may be aligned with corresponding curved side faces 58*b* of the container body 13. Thereby, as shown in FIG. 1, the size and shape of the outer periphery of the container body 13 may be generally maintained along the height of the assembled container 12 and closure assembly 10. As described below, such maintenance of the size and shape of the container body 13 enables advantageous positioning of a first container and closure assembly relative to a second container and closure assembly, such as through stacking or grouping. It will be appreciated that the body 213 may be formed with any suitable height.

Figure 2A:
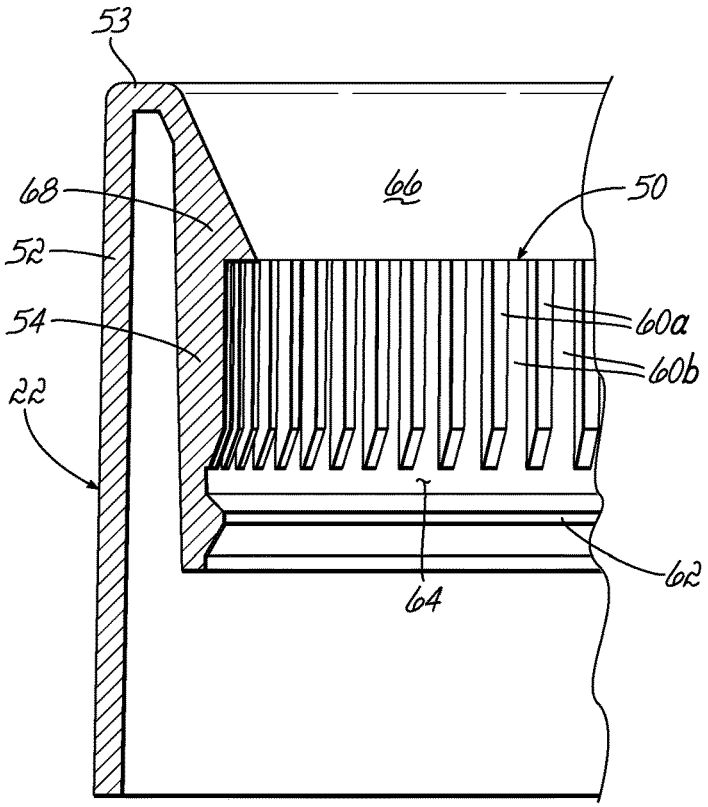
FIG. 2A is an enlarged cross-sectional view taken along line 2A-2A of FIG. 2, showing details of an outer shell of the tamper-evident closure assembly.
Figure 2B:
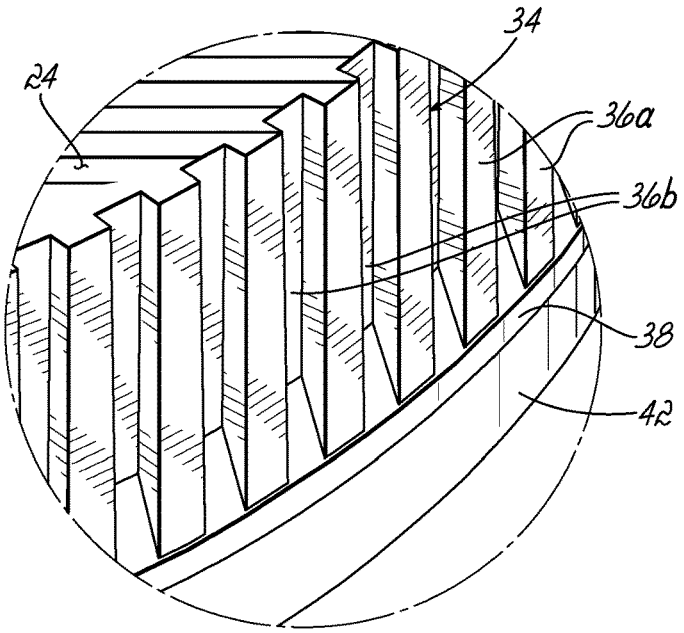
FIG. 2B is an enlarged view of the encircled area 2B in FIG. 2, showing details of an annular skirt wall of the cap.

In one embodiment, as best shown in FIGS. 2 and 2A, the inner annular wall 54 may include a plurality of uniformly spaced axial ribs 60*a* projecting radially inward and defining a corresponding plurality of axial grooves 60*b* between each pair of adjacent ribs 60*a*. The axial ribs 60*a* and corresponding axial grooves 60*b* on the outer shell 22 may be sized and configured to mate with the axial ribs 36*a* and corresponding axial grooves 36*b*, respectively, on the cap 18. Thereby, when the cap 18 is received within the central aperture 50 and secured with the outer shell 22, as described below, the cap 18 is rotationally locked with the outer shell 22 such that the cap 18 and outer shell 22 rotate together. In this manner, a rotational force exerted on the outer shell 22 is transferred directly to the cap 18 through the engaged axial ribs 36*a*, 60*a* and axial grooves 36*b*, 60*b*. Similarly, a rotational force exerted on the cap 18 is transferred directly to the outer shell 22 through the engaged axial ribs 36*a*, 60*a* and axial grooves 36*b*, 60*b*. In alternative embodiments, the cap 18 and outer shell 22 may be provided with any other features suitable for rotatably locking the cap 18 with the outer shell 22.

Referring now to FIGS. 3 and 4, in one embodiment, the cap 18 is received within the central aperture 50 of the outer shell 22, and the cap 18 is operatively secured to the outer shell 22, as now described. For example, the cap 18 may be releasably engaged with the outer shell 22. As shown best in FIGS. 2, 2A, and 4, the inner annular wall 54 of the outer shell 22 may include an annular ledge 62 that is spaced axially beneath the axial ribs 60*a* so as to define a circumferential groove 64. As shown in FIG. 4, the cap 18 may be mounted within the outer shell 22 such that the circumferential groove 64 engages and retains the outwardly projecting annular bead 38 on the cap 18. Additionally, the inner annular wall 54 may be biased toward the cap skirt wall 34. In this manner, the cap 18 is operatively secured to the outer shell 22, for example to prevent upward axial movement of the outer shell 22 relative to the cap 18.

The inner annular wall 54 of the outer shell 22 may further include an angled surface 66 defining an annular finger 68 that projects inwardly, as best shown in FIG. 4. The annular finger 68 may abut the top wall 24 of the cap 18 and thereby prevent downward axial movement of the outer shell 22 relative to the cap 18. Accordingly, the annular finger 68 and annular ledge 62 defining the circumferential groove 64 may operate together to prevent, or at least minimize, axial movement of the outer shell 22 relative to the cap 18. The annular finger 68 and annular ledge 62 may each be continuous in structure, as shown, or alternatively they may be discontinuous. Moreover, as described above, rotational movement between the outer shell 22 and cap 18 may be substantially prevented by engagement of the axial ribs and grooves 36*a*, 36*b* on the cap 18 with the axial ribs and grooves 60*a*, 60*b* on the outer shell 22. Accordingly, in the embodiment shown, the outer shell 22 and cap 18 are substantially fixed axially and rotationally relative to each other.

In one embodiment, when the cap 18 is secured to the outer shell 22, the annular skirt wall 34 of the cap 18 and the tamper-evidencing member 20 are peripherally surrounded by the outer shell 22. In particular, as shown in FIG. 4, the inner annular wall 54 peripherally surrounds the annular skirt wall 34, and the outer annular wall 52 extends axially beyond the inner annular wall 54 to peripherally surround the tamper-evidencing member 20. Additionally, the cap 18 may be mounted with the outer shell 22 such that the cap boss 26 protrudes axially from the central aperture 50. In particular, a top portion of the boss 26, including the top surface 30, may extend beyond the upper wall 53 of the outer shell 22. A generally annular cavity 74 is defined between the side faces 28*a*, 28*b* of the cap boss 26 and the angled surface 66 of the outer shell 22.

As discussed above, the cap 18 is securable to the container 12 to close the container opening 16. In one embodiment, the cap 18 may be threadedly engaged with the container neck 14. In particular, a radially inner surface of the cap skirt wall 34 may include a threaded portion 70 configured to engage a corresponding threaded portion 72 provided on a radially outer surface of the container neck 14. The threaded portions 70, 72 may include helical threads or any other structure suitable for releasable engagement, such as non-helical tabs. Additionally, the cap 18 may be fitted with a disk-shaped sealing member 76 that provides a seal between the cap 18 and a mouth 78 of the container 12. The sealing member 76 may be formed of any material suitable for creating a reliable seal, which may be an air-tight seal.

When the cap 18 is secured to the container 12, as described above, the tamper-evident band 40 is secured with the container neck 14. In particular, in one embodiment, a radially inner surface of the band 40 may include an annular finger 80 that projects radially inward to engage an annular rib 82 that projects radially outward from the neck 14 of the container 12, as shown in FIG. 4. The annular finger 80 and annular rib 82 may each be continuous or discontinuous. For example, the annular finger 80 may include a plurality of circumferentially spaced annular segments. As shown, the annular rib 82 may overlie and abut the annular finger 80 to thereby retain the band 40 on the container neck 14 when the cap 18 is removed from the container 12, as described below with reference to FIGS. 5 and 6.

Referring to FIGS. 2-4, and in view of the various features described above, methods of closing the container 12 with the tamper-evident closure assembly 10 will now be described. In one embodiment, the outer shell 22 may be positioned above and about the cap 18 such that: (i) the inner annular wall 54 of the outer shell 22 is aligned coaxially with the annular skirt wall 34 of the cap 18; (ii) the planar side faces 56*a* of the outer shell 22 are aligned parallel with the planar side faces 28*a* of the cap 18; and (iii) the axial ribs and grooves 36*a*, 36*b* of the cap 18 are aligned for engagement with the axial ribs and grooves 60*a*, 60*b* of the outer shell 22. The cap 18 and outer shell 22 may then be pressed together axially such that the cap 18 is received within the central aperture 50 of the outer shell 22, and the two components 18, 22 are secured in the manner described above such that they are non-rotatable relative to each other. The assembled outer shell 22 and cap 18, and the tamper-evidencing member 20 carried thereby, may then be offered up to opening 16 of the container the container 12. The cap 18 may be aligned coaxially with the mouth 78 defined by the container neck 14. A rotational force, for example in a clock-wise direction, may be applied to the outer shell 22 or to the cap boss 26 to threadedly engage the cap 18 with the container neck 14.

In an embodiment where the threaded portions 70, 72 on the cap 18 and neck 14 are helical, rotation of the cap 18 may advance the closure assembly 10 downwardly toward the container body 13. In this manner, the cap 18 may be tightened onto the neck 14 such that the annular finger 80 on the tamper-evident band 40 snaps over and into engagement with the annular rib 82 on the container neck 14. As described above, the stop element 48*a* and abutment element 48*b* may cooperate to prevent breakage of the slender webs 44 while the cap 18 is rotated onto the neck 14.

As generally described herein with regard to a preferred embodiment, the outer shell 22 may be secured to the cap 18 before the cap 18 is secured to the container 12, for example by threaded engagement. In this manner, the combined outer shell 22, cap 18, and tamper-evidencing member 20 carried thereby may then be joined to the container 12 in one subsequent step. In an alternative embodiment, the cap 18 and tamper-evidencing member 20 carried thereby may first be secured to the container 12 in the manner described above, followed by securing the outer shell 22 to the cap 18 in the manner described above. Preferably, after securing the outer shell 22 to the cap 18 during assembly of the closure assembly 10, the outer shell 22 and cap 18 remain secured to one another during subsequent use of the closure assembly 10.

Figure 5:
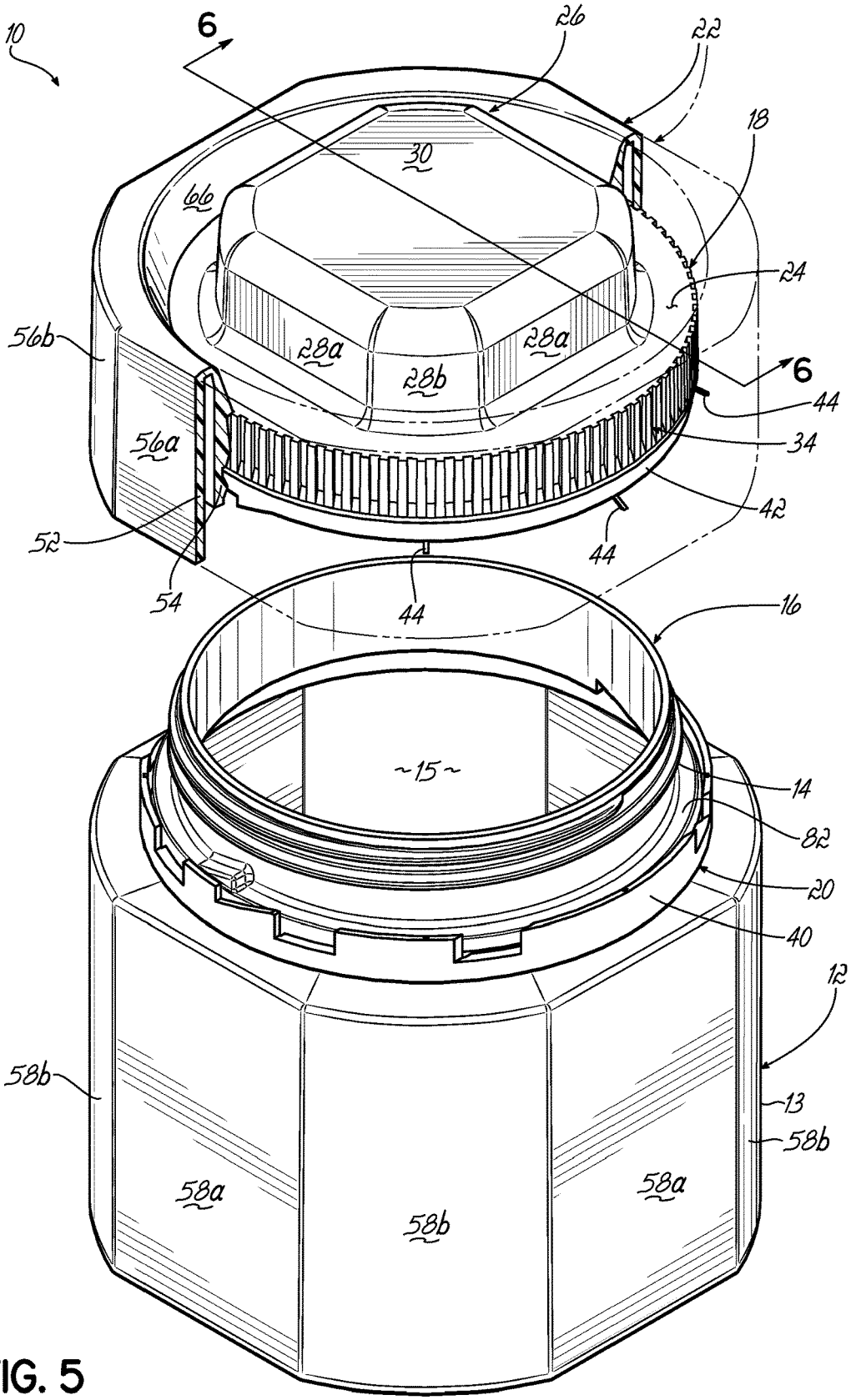
FIG. 5 is an isometric view showing the tamper-evident closure assembly and container of FIG. 1 after the cap has been removed from the container, the outer shell being shown partially broken away.
Figure 6:
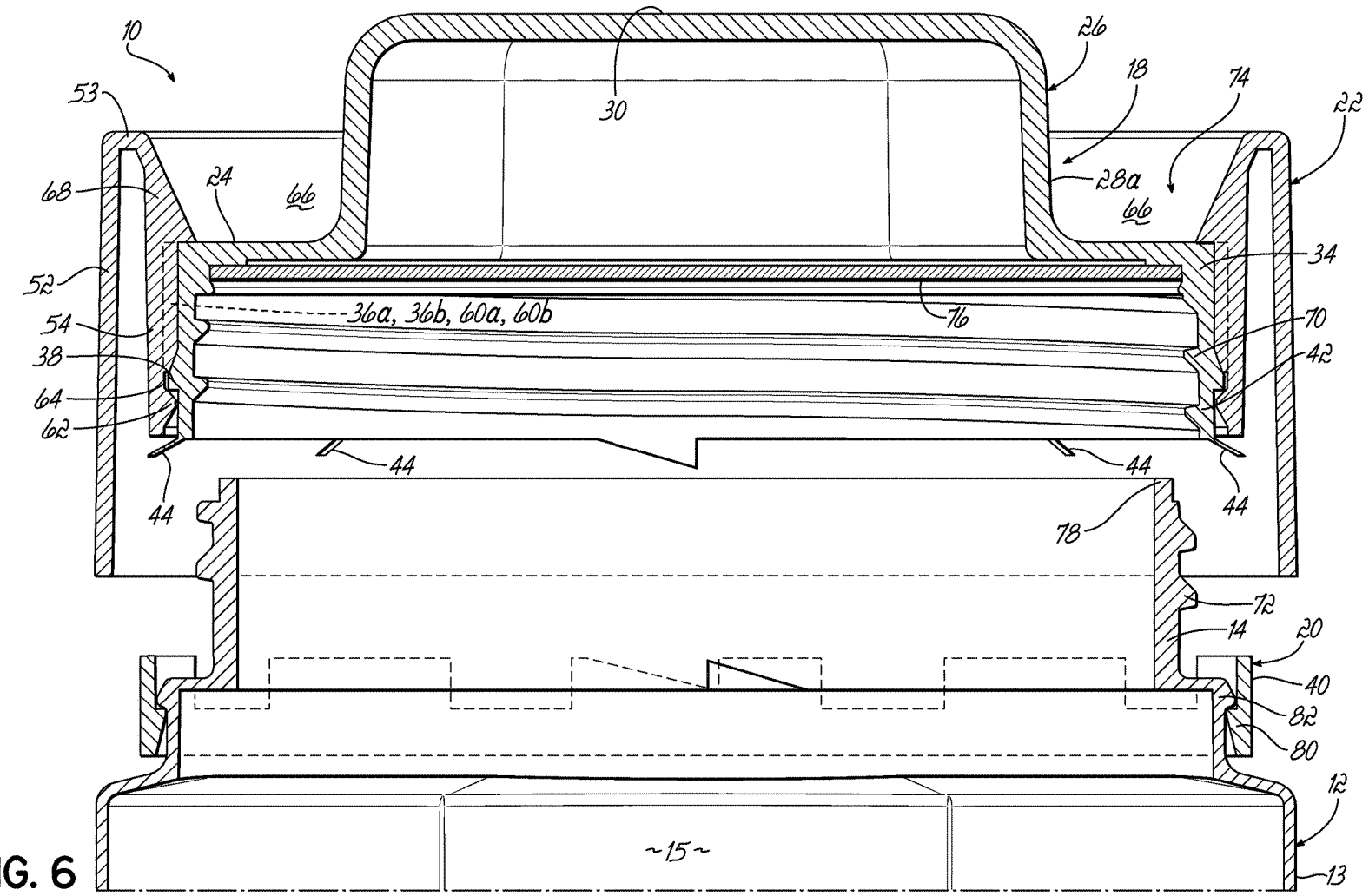
FIG. 6 is a cross-sectional view taken generally along section line 6-6 of FIG. 5, showing the cap removed from the container and positioned slightly closer to the container than shown in FIG. 5.

Referring to FIGS. 5 and 6, the cap 18 may be removed from the container 12 so as to break the frangible connection formed by the slender webs 44 of the tamper-evidencing member 20. In particular, the cap 18 may be rotated, for example by exerting a counter-clockwise rotational force on the outer shell 22 or the cap boss 26, such that the cap 18 and outer shell 22 advance axially upward, away from the container body 13. As the cap 18 continues to advance upwardly, the tamper-evident band 40 is retained on the neck 14 by the annular rib 82, and the slender webs 44 stretch and eventually fail such that the frangible connection is broken. As shown, the combined cap 18 and outer shell 22 may be lifted free from the container 12, thereby exposing the broken webs 44 and the tamper-evident band 40 so as to indicate to a user, and to any subsequent users, that the container 12 has been opened. The combined cap 18 and outer shell 22 may then be re-secured with the container 12, as generally described above.

Figure 7C:
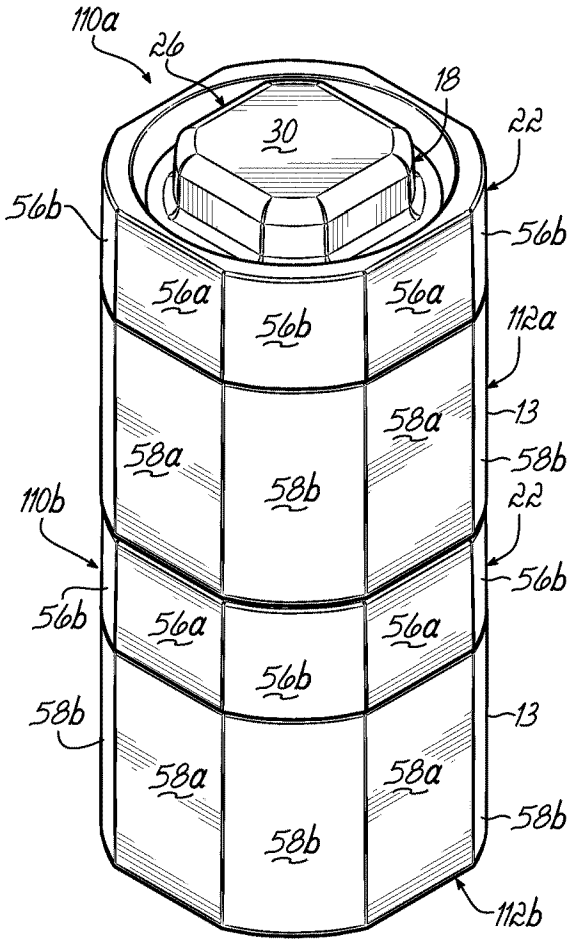
FIG. 7C is an isometric view showing the upper container and closure assembly of FIG. 7B stacked on top of the lower container and closure assembly of FIG. 7B.
Figure 7B:
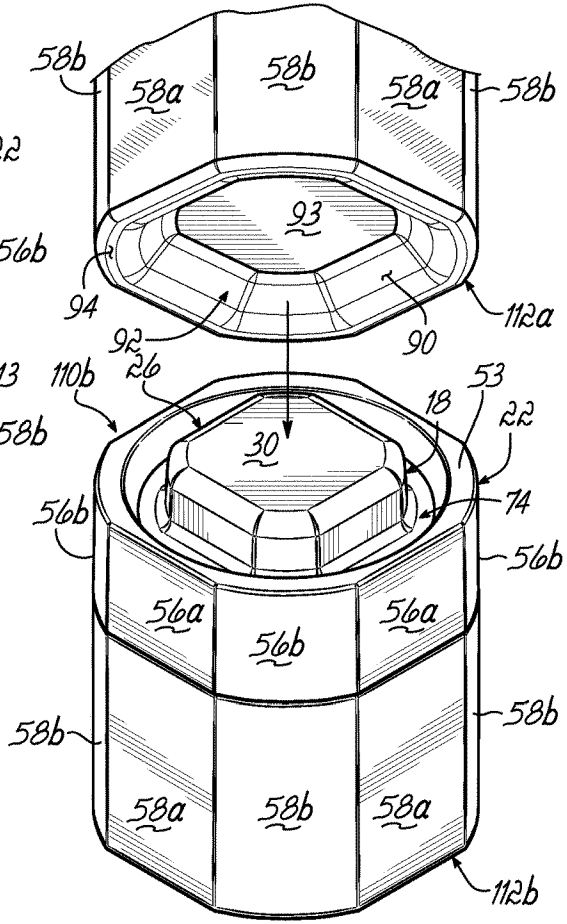
FIG. 7B is an isometric view showing an upper container of the embodiment of FIG. 1 being positioned for stacking on top of a closure assembly of a lower container of the embodiment of FIG. 1.
Figure 7A:
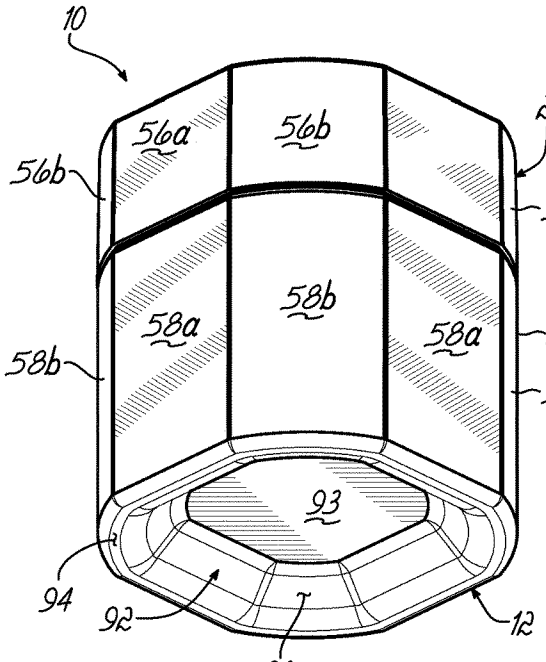
FIG. 7A is an isometric view showing details of a bottom wall of the container of FIG. 1.

Referring to FIGS. 7A-7C, a bottom wall 90 of the container 12 may be formed with a depression or cavity 92 extending axially toward the neck 14 and having a cavity base 93. The cavity 92 may be sized and shaped such that a top portion of the cap boss 26 may be received therein. For example, the cavity 92 may be formed to substantially correspond in size and shape to the octagonally arranged planar side faces 28*a* and curved side faces 28*b* of the boss 26. Furthermore, the bottom wall 90 may include a planar base surface 94 that is formed to substantially correspond in size to the upper wall 53 of the outer shell 22.

Referring to FIGS. 7B and 7C, upper and lower containers 112*a* and 112*b*, and corresponding upper and lower tamper-evident closure assemblies 110*a* and 110*b*, are shown. The containers 112*a*, 112*b* may each include the same features as container 12 described above. Similarly, the tamper-evident closure assemblies 110*a*, 110*b* may each include the same features as the tamper-evident closure assembly 10 described above. In that regard, like numerals refer to like features. Furthermore, the closure assemblies 110*a*, 110*b* and corresponding containers 112*a*, 112*b* may be assembled in the manners generally described above. For example, in one embodiment, the outer shell 22 may first be secured to the cap 18, and the combination may then be secured to the corresponding container 112*a*, 112*b*. In another embodiment, the cap 18 may first be secured to the corresponding container 112*a*, 112*b*, and the outer shell 22 may then be secured to the cap 18.

As shown, the containers 112*a*, 112*b* and corresponding closure assemblies 10*a*, 10*b* may be stacked one on top of another so that the upper container 112*a* is nested with the lower closure assembly 110*b*. In particular, a protruding top portion of the cap boss 26 of the lower closure assembly 110*b* may be received within the cavity 92 formed in the bottom wall 90 of the upper container 112*a*. Additionally, the planar base surface 94 on the bottom wall 90 of the upper container 112*a* may contact and be supported by the upper wall 53 of the lower closure assembly 110*b*.

As shown, the outer periphery of the body 13 of the upper container 112*a* may be substantially aligned with the outer periphery of the outer shell 22 of the lower closure assembly 110*b*. As described above with respect to container 12 and closure assembly 10, the maximum outer periphery of the outer shell 22 may be aligned with the maximum outer periphery of the container 12. Accordingly, as shown in FIG. 7C, the respective maximum outer peripheries of the outer shell 22 of the upper closure assembly 110*a*, the upper container 112*a*, the outer shell 22 of the lower closure assembly 110*b*, and the lower container 112*b*, may be in alignment with each other. In this manner, the stacked components 110*a*, 112*a*, 110*b*, 112*b* may define a global outer periphery of substantially uniform shape along the height of the stacked assembly. This feature is advantageous for stacking multiple containers 12 and corresponding tamper-evident closure assemblies 10, and for arranging multiple groups of stacked components side by side, for example.

Referring to FIGS. 8-11C, a closure assembly 210 and a container 212 according to another exemplary embodiment of the present invention are shown. The closure assembly 210 and container 212 are similar in construction and function to the closure assembly 10 and container 12 of FIG. 1 except as otherwise described below. In that regard, similar reference numerals, including those not described in detail below, refer to similar features shown and described in connection with closure assembly 10 and container 12 of FIGS. 1-7C.

The closure assembly 210 includes a cap 218, a tamper-evidencing member 220 carried by the cap 218, and an outer shell 222 that may be positioned about and operatively secured to the cap 218 such that the cap 218 is non-rotatable relative to the outer shell 222.

The cap 218 includes a top wall 224 and a boss 226 projecting upwardly from the top wall 224. The boss 226 may be generally polygonally shaped. For example, as shown, the boss 226 may be generally octagonal and include a set of eight side faces, four of which are generally planar side faces 228*a* and four of which are generally curved side faces 228*b*. Each of the curved side faces 228*b* may be positioned between an adjacent set of planar side faces 228*a*. The boss 226 may also include a generally planar top surface 230.

An annular skirt wall 234 depends axially downward from the cap top wall 224 and includes a plurality of circumferentially spaced planar faces 235. For example, in illustrated embodiment the skirt wall 234 includes four planar faces 235 spaced at intervals of approximately 90 degrees. In alternative embodiments, any suitable quantity and circumferential arrangement of planar faces 235 may be provided. Each of the planar faces 235 includes an axial rib 236 projecting radially outward and extending axially. As described in greater detail below, the planar faces 235 and axial ribs 236 engage corresponding features on the outer shell 222 to prevent relative rotation between the cap 218 and the outer shell 222.

An outwardly projecting annular bead 238 is formed on a bottom portion of the skirt wall 234 at the lower ends of the planar faces 235, and may extend circumferentially about the skirt wall 234. While the annular bead 238 is shown as a continuous structure, it will be appreciated that the annular bead 238 may alternatively be formed of one or more discontinuous segments. As described in greater detail below, the annular bead 238 operates to secure the cap 218 to the outer shell 222.

It will be appreciated that the tamper-evidencing member 220 carried by the cap 218 is substantially similar in construction and function to the tamper-evidencing member 20 described above. Accordingly, the tamper-evidencing member 220 is not described in detail herein.

The outer shell 222 includes a central aperture 250 through which the cap 218 is received for operatively securing the cap 218 to the outer shell 222. The outer shell 222 includes an outer annular wall 252 defining an outer periphery of the outer shell 222, and an inner annular wall 254 defining the central aperture 250. The outer and inner annular walls 252, 254 may be joined together by a web-like upper wall 253. Additionally, the outer shell 222 may be generally polygonally shaped. In particular, the outer shell 222 may be generally octagonal so as to correspond in size and shape to a generally octagonal outer periphery defined by the body 213 of the container 212. In this regard, the outer periphery of outer shell 222 may include a set of eight faces, four of which are generally planar side faces 256*a* and four of which are generally curved side faces 256*b*. Each of the curved side faces 256*b* may be positioned between an adjacent set of planar side faces 256*a*.

Figure 11A:
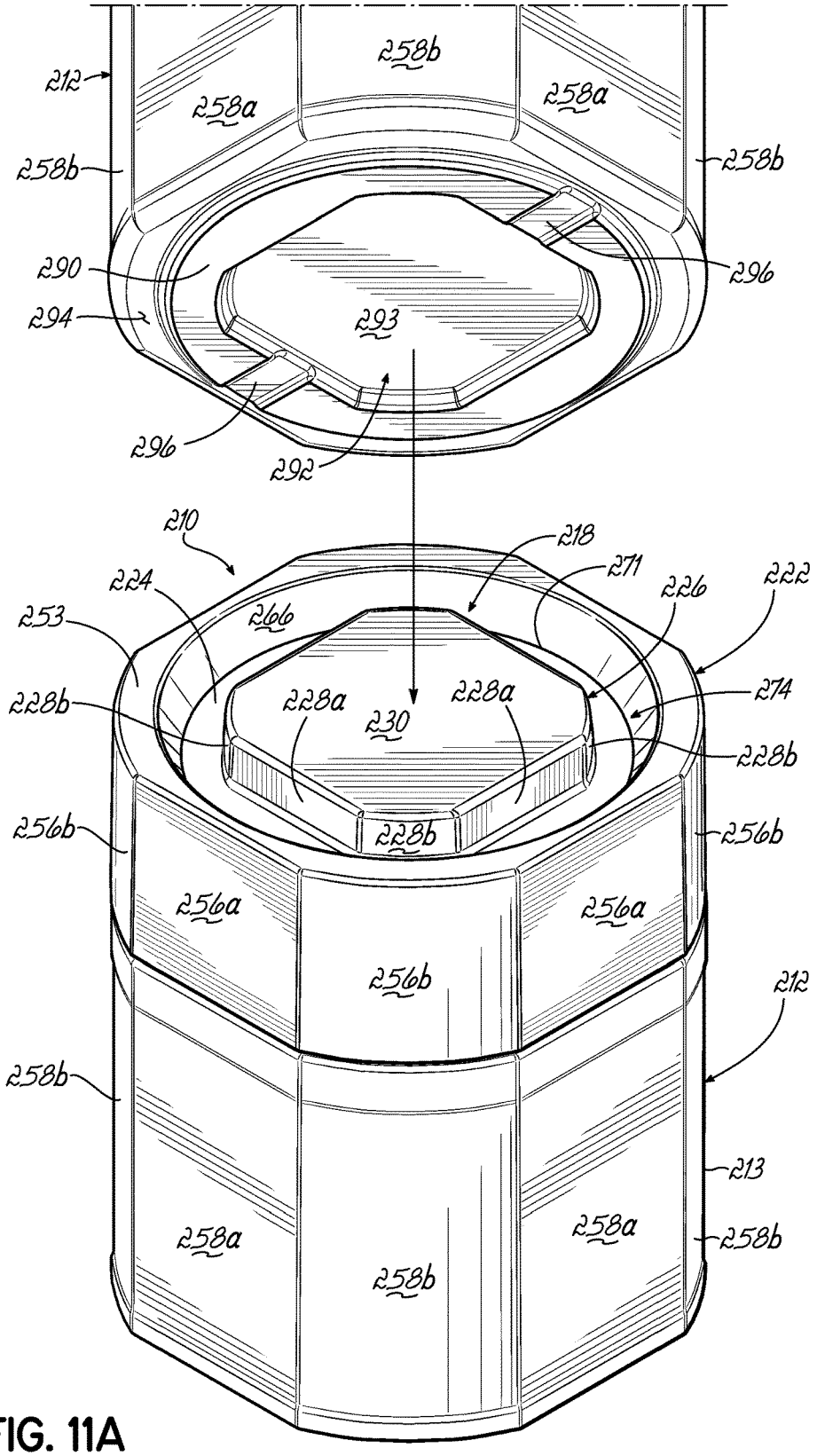
FIG. 11A is an isometric view showing an upper container of the embodiment of FIG. 8 being positioned for stacking on top of a closure assembly of a lower container of the embodiment of FIG. 8.
Figure 11B:
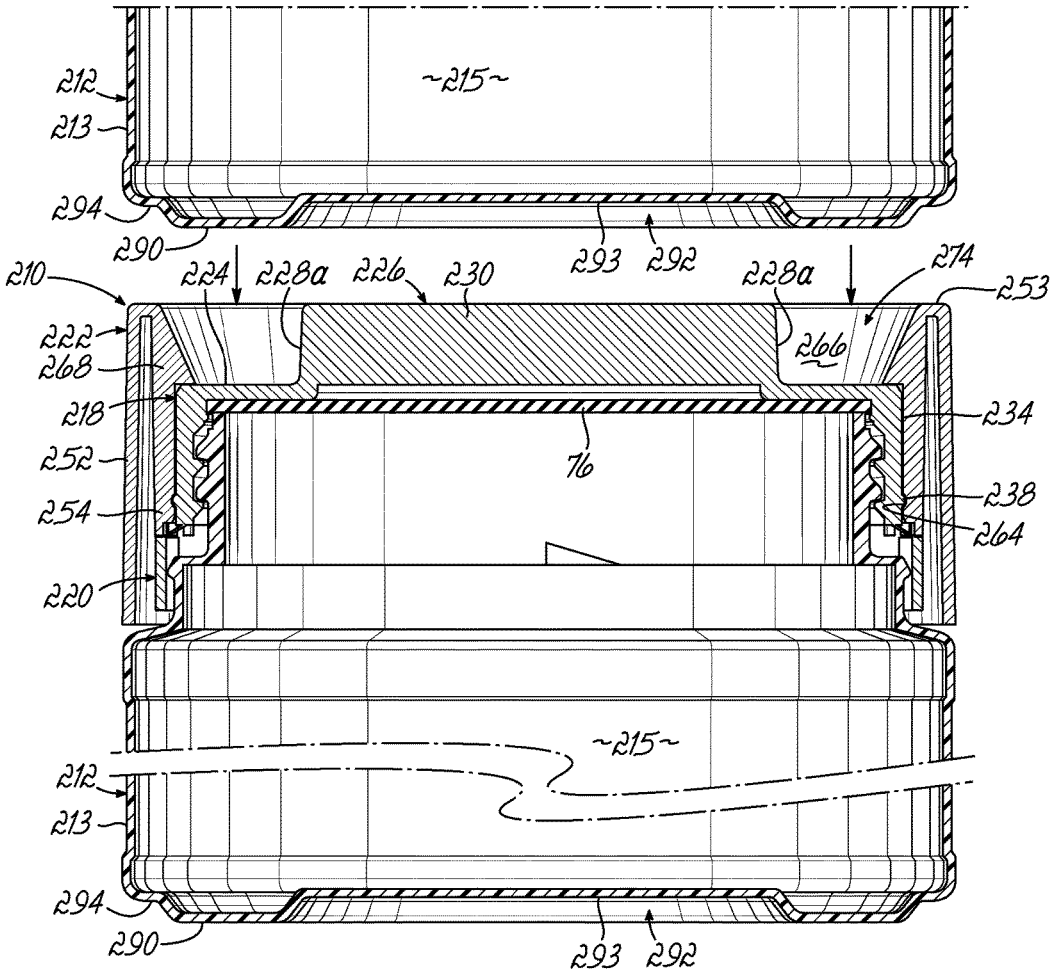
FIG. 11B is a side cross-sectional view taken generally along line 11-11 of FIG. 8, showing the upper container of FIG. 11A positioned for stacking on top of the closure assembly of the lower container of FIG. 11A.

The inner annular wall 254 of the outer shell 222 includes an angled surface 266 defining an upper annular finger 268 that projects inwardly, as best shown in FIG. 11B. The annular finger 268 abuts the top wall 224 of the cap 218 and thereby prevents downward axial movement of the outer shell 222 relative to the cap 218.

The inner annular wall 254 further includes a cylindrical surface 263 extending downwardly from the annular finger 268. The cylindrical surface 263 includes a plurality of circumferentially spaced planar faces 265, each having an axial groove 267 having a tapered lead-in portion 269. The quantity and circumferential arrangement of the planar faces 265 and axial grooves 267 on the outer shell 222 generally corresponds to that of the planar faces 235 and axial ribs 236 on the cap 218. In that regard, while four planar faces 265 and axial grooves 267 arranged at 90 degree intervals are shown herein, any suitable alternative quantity and arrangement may be provided. The cylindrical surface 263 further includes a circumferential groove 264 positioned adjacent the lower ends of the planar faces 265.

Figure 10A:
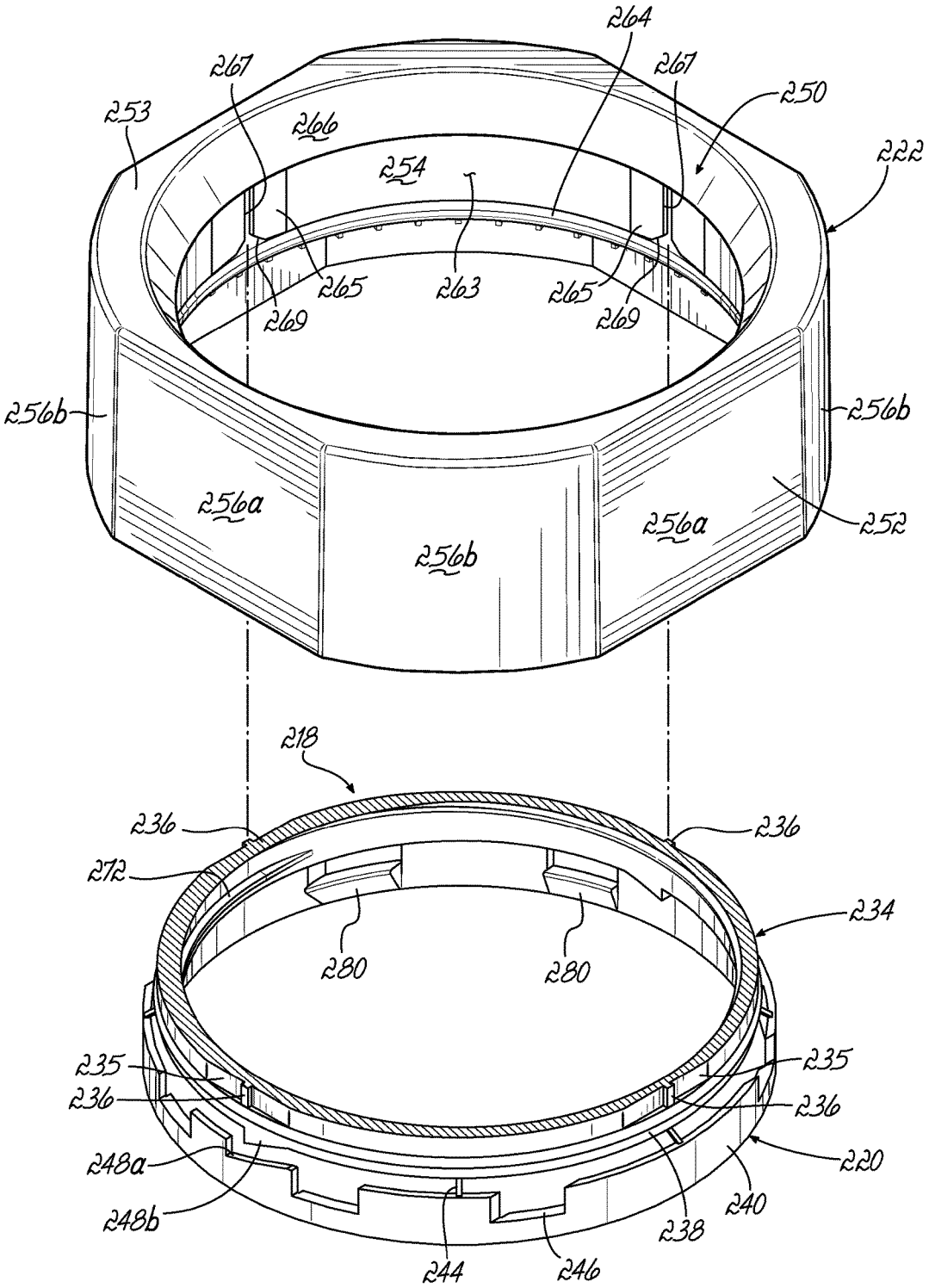
FIG. 10A is an isometric disassembled view of the tamper-evident closure assembly of FIG. 8, with an upper portion of a cap of the closure assembly being hidden from view.
Figure 10B:
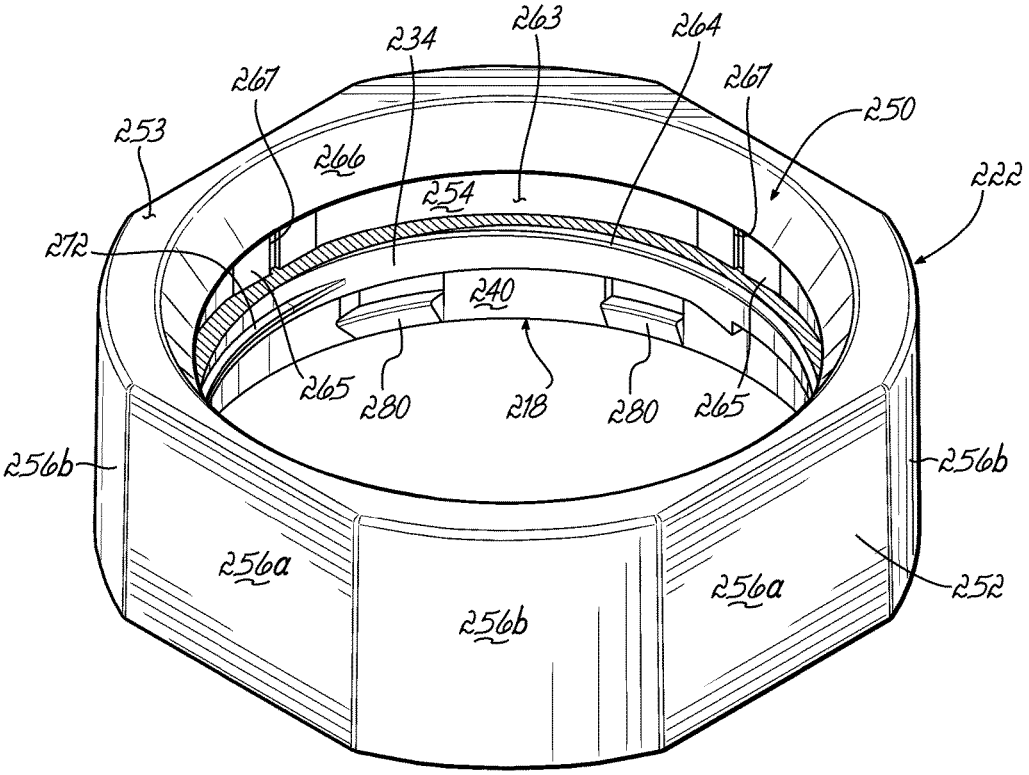
FIG. 10B is an isometric view similar to FIG. 10A, showing the cap assembled with an outer shell, with the upper portion of the cap being hidden from view.

As shown in FIGS. 10A and 10B, the cap 218 is aligned coaxially with and received within the central aperture 250 of the outer shell 222, such that the skirt wall 234 of the cap 218 confronts and engages the annular inner wall 254 of the outer shell 222. In particular, each planar face 235 and axial rib 236 on the cap 218 is aligned with and received by a respective one of the planar faces 265 and axial grooves 267 formed on the outer shell 222. The tapered lead-in portions 269 of the axial grooves 267 facilitate alignment of the axial ribs 236 with the axial grooves 267 during assembly. The engagement between the planar faces 235, 265 and between the axial ribs 236 and axial grooves 267 substantially prevents relative rotation between the cap 218 and the outer shell 222. Furthermore, the outwardly projecting annular bead 238 formed on the cap 218 is received by the circumferential groove 264 on the outer shell 222 with a snap-fit engagement, thereby preventing unwanted axial separation of the cap 218 from the outer shell 222.

Figure 8:
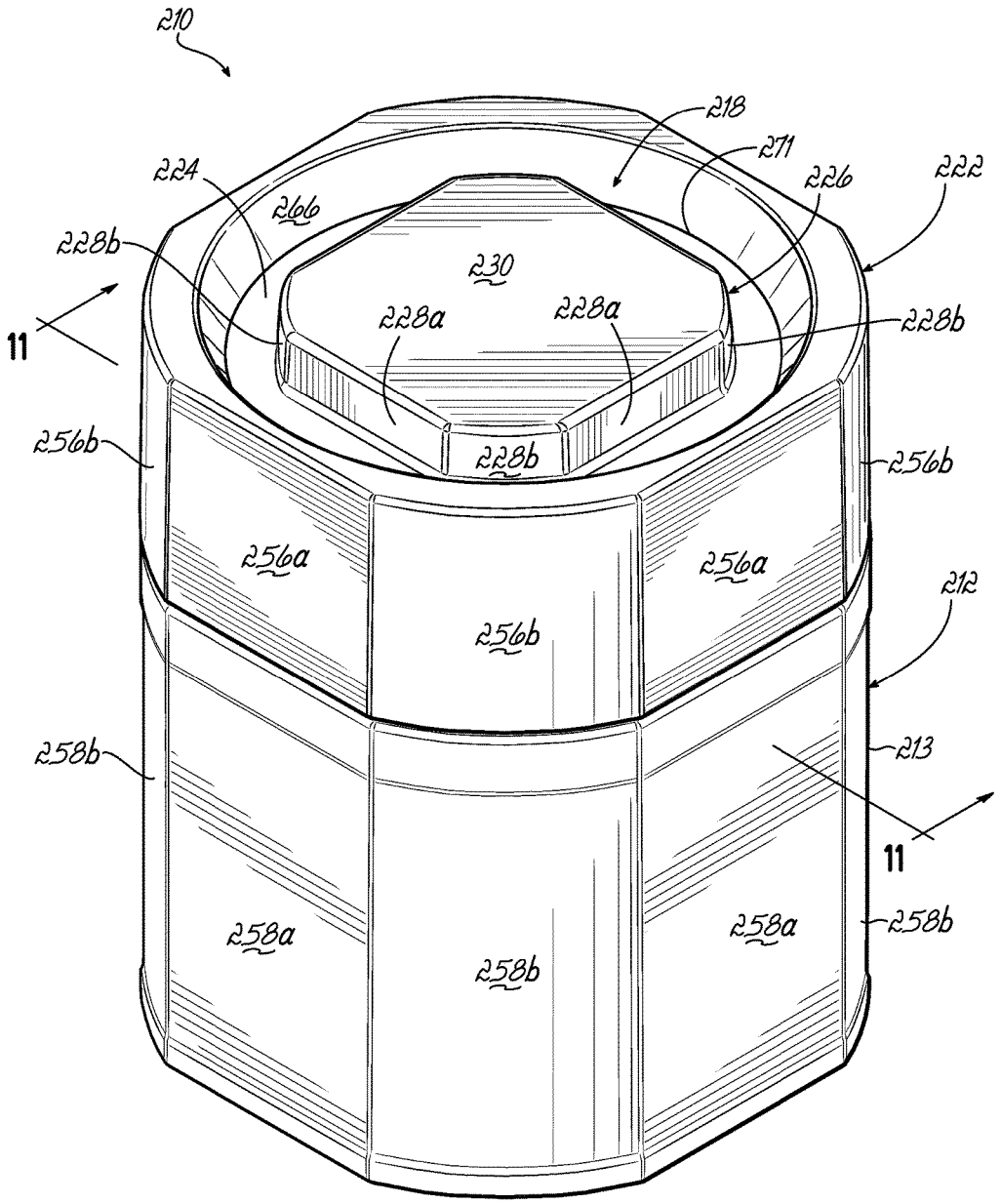
FIG. 8 is an isometric view showing a tamper-evident closure assembly in combination with a container according to another embodiment of the present invention.
Figure 9:
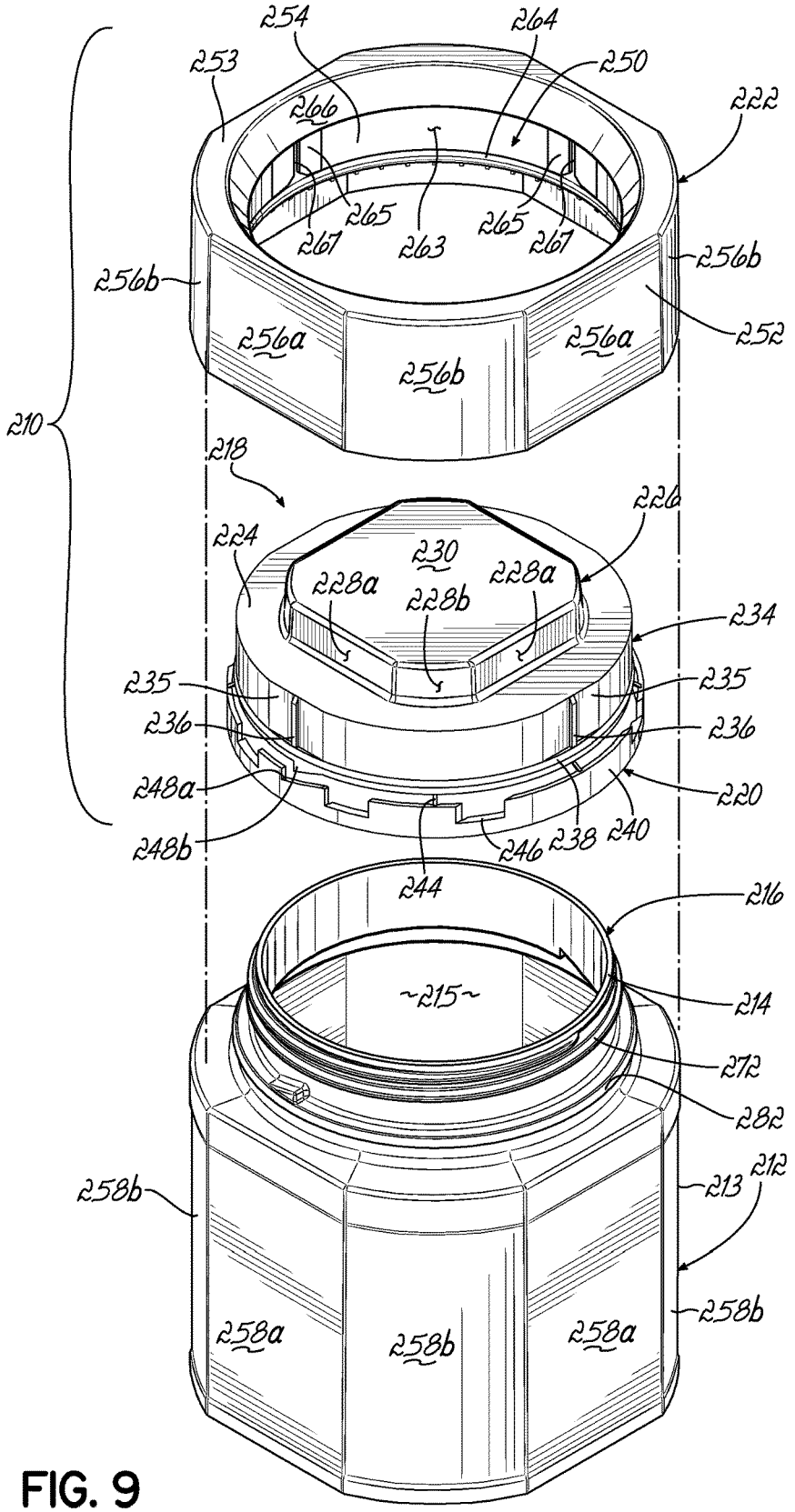
FIG. 9 is an isometric partially disassembled view showing the tamper-evident closure assembly and container of FIG. 8.

As best shown in FIGS. 8 and 11A, the assembled cap 218 and outer shell 222 define an annular seam 271 at the location where the lower edge of angled surface 266 of the outer shell 222 confronts the top wall 224 of the cap 218. In one embodiment, the assembled cap 218 and outer shell 222 may be ultrasonically welded together at the annular seam 271, thereby creating a welded bond between the cap 218 and outer shell 222 for further preventing relative rotational or axial movement between the assembled cap 218 and the outer shell 222. Ultrasonic welding, or any other suitable method of permanent bonding, may be formed at various alternative or additional locations at which a surface of the outer shell 222 confronts a surface of the cap 218. Accordingly, the outer shell 222 and cap 218 may be substantially fixed axially and rotationally relative to each other. In many preferred embodiments, the cap 218 may be coupled with the outer shell 222, as generally described above, prior to securing the closure assembly 210 to the neck 214 of the container 212.

As best shown in FIG. 11B, the outer shell 222 peripherally surrounds the skirt wall 234 and boss 226 of the cap 218 after assembly. Furthermore, the features of the cap 218 and the outer shell 222 are sized such that when the cap 218 is fully mated with the outer shell 222, the top surface 230 of the cap boss 226 does not extend axially beyond the upper wall 253 of the outer shell 222. More particularly, in an exemplary embodiment, the top surface 230 of the boss 226 is substantially coplanar with the top surface of the upper wall 253. Consequently, and advantageously, the outer shell 222 generally protects the cap 218 from unwanted contact with external objects. Additionally, the outer shell 222 may act as a shock absorbing structure when an external force is exerted generally laterally on the closure assembly 210, for example by an external object or a ground surface if the closure assembly 210 is dropped. In that regard, the outer annular wall 252 may elastically deform in a direction radially inward toward the inner annular wall 254 and then spring back to its original shape, thereby absorbing a majority of the external force rather than transferring it to the cap 218. Furthermore, the outer shell 222 may separate from the cap 218 when impacted by a force, so that the outer shell 222 absorbs the shock of the impact force without transferring shock to the cap 218.

As shown best in FIG. 8, the body 213 of the container 212 may include generally planar side faces 258*a* and generally curved side faces 258*b*, patterned in a manner similar to the planar and curved side faces 256*a*, 256*b* of the outer shell 222. When the outer shell 222 is engaged with the cap 218, which in turn is secured to the container 212, the outer periphery of the outer shell 222 may substantially correspond in size and shape with the outer periphery of the container body 213, such as the radially outermost or maximum periphery. As shown best in FIGS. 11B and 11C, the upper and lower portions of the container body 213 may be formed with slightly larger radial dimensions than the intermediate portion of the container body 213. The body 213 may be formed with any suitable height.

Figure 11C:
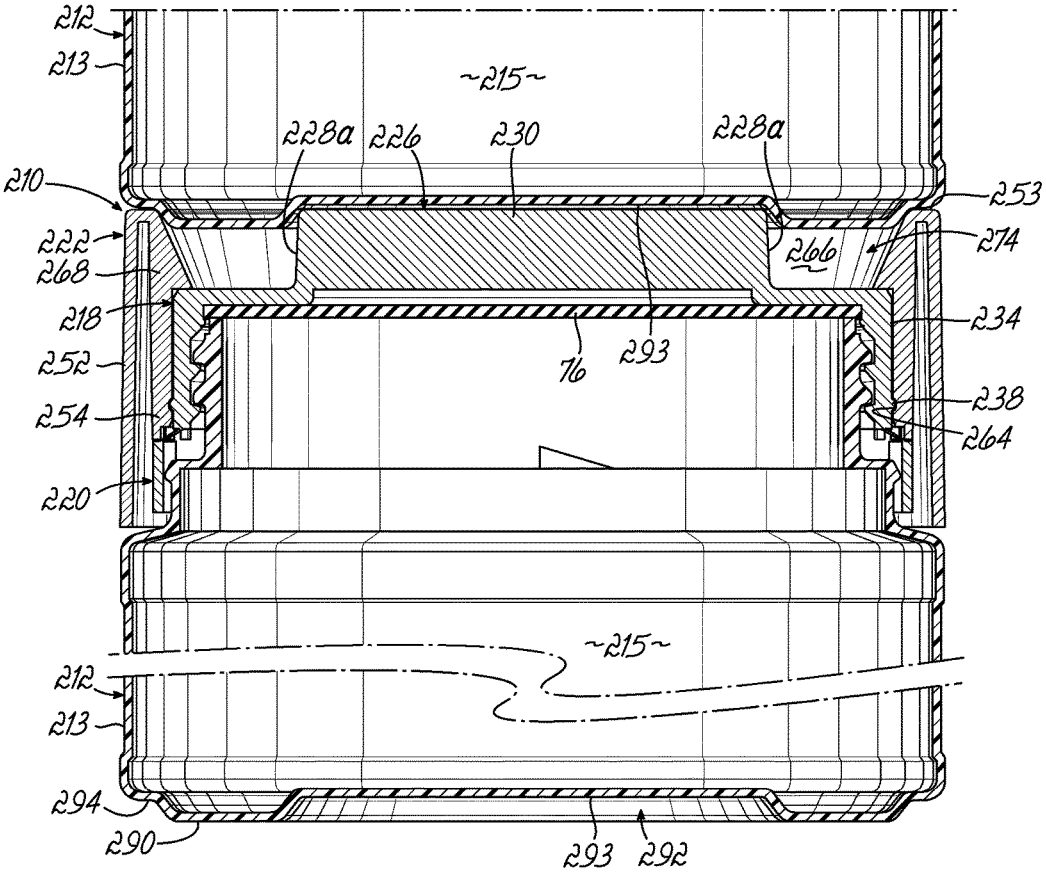
FIG. 11C is a side cross-sectional view similar to FIG. 11B, showing the upper container seated on top of the closure assembly of the lower container.

Referring to FIGS. 11A-11C, the assembled tamper-evident closure assembly 210 and container 212 is stackable with one or more additional closure assemblies 210 and containers 212. As shown best in FIGS. 8 and 11A, the assembled cap 218 and outer shell 222 define a generally annular cavity 274 extending between the side faces 228*a*, 228*b* of the cap boss 226 and the angled surface 266 of the outer shell 222. The annular cavity 274 is generally sized and shaped to receive a bottom wall 290 that protrudes axially outward from a bottom end of the container 212. The bottom wall 290 is surrounded by a planar base surface 294 that substantially corresponds in size and shape to the upper wall 253 of the outer shell 222. The bottom wall 290 includes a central cavity 292 having a cavity base 293, the central cavity 292 being generally sized and shaped to receive the top portion, including the top surface 230, of the cap boss 226. The bottom wall 290 may further include a pair of diametrically opposed channels 296, each opening to the central cavity 292 at an inner end and to the base surface 294 at the outer end.

Thus, as shown in FIG. 11C, an upper container 212 may be stacked, or nested, with the closure assembly 210 of a lower container 212 such that the protruding bottom wall 290 of the upper container 212 is received within the annular cavity 274 of the lower closure assembly 210. Additionally, the upper portion of the cap boss 226 of the lower closure assembly 210 is received within the central cavity 292 of the upper container 212. In this manner, the base surface 294 and the cavity base 293 of the upper container 212 confront and may be supported by the upper wall 253 and the cap top surface 230, respectively, of the lower closure assembly 210.

Similar to manner shown in FIG. 7C, the outer periphery of the body 213 of the upper container 212 may be substantially aligned with, and generally correspond in size and shape to, the outer periphery of the outer shell 222 of the lower closure assembly 210. Accordingly, stacked containers 212 and closure assemblies 210 may define a global outer periphery of substantially uniform shape along the height of the stacked assembly.

Figure 12:
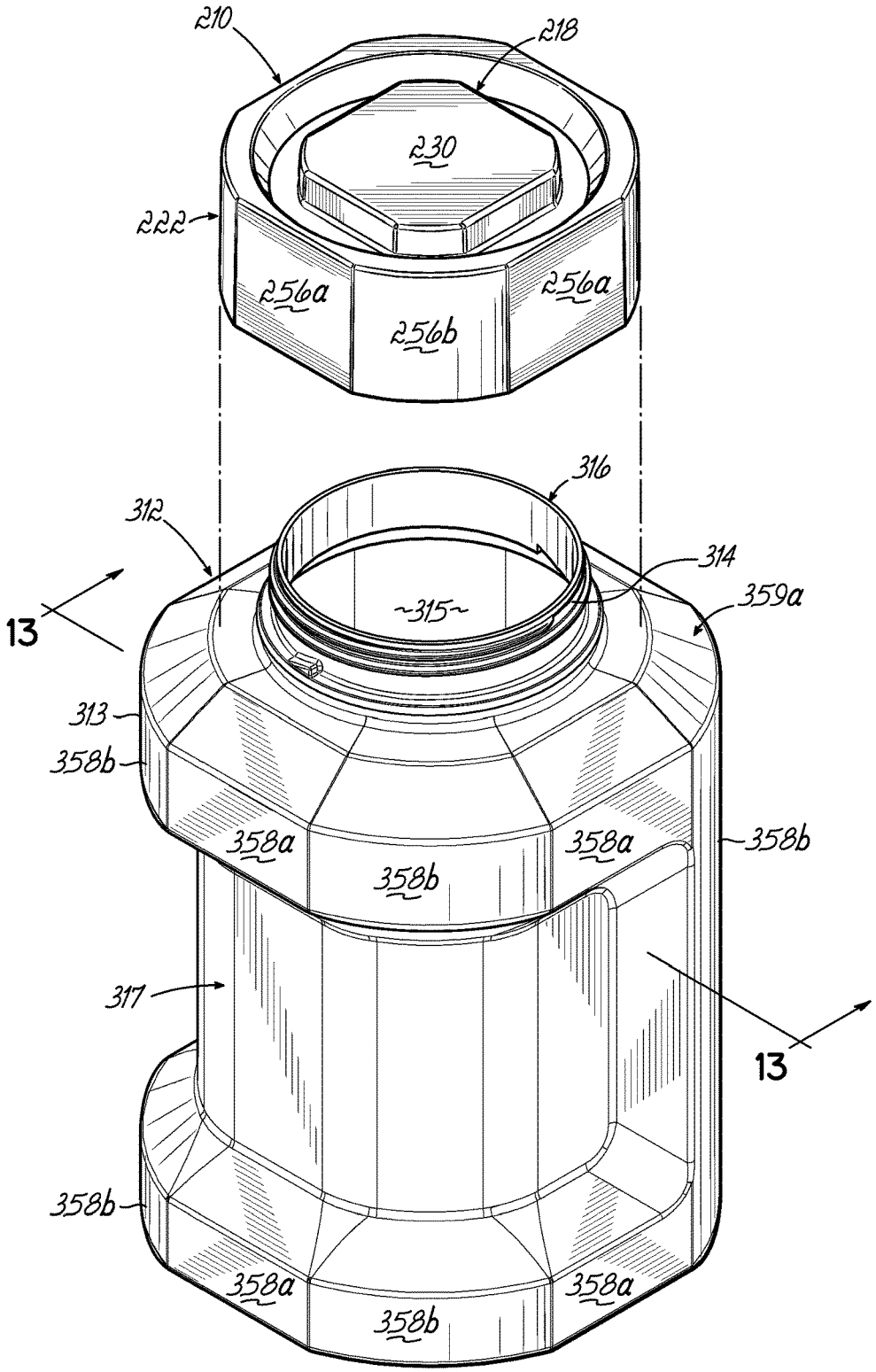
FIG. 12 is an isometric view showing the tamper-evident closure assembly of FIG. 8 in combination with a container according to another embodiment of the present invention.
Figure 13A:
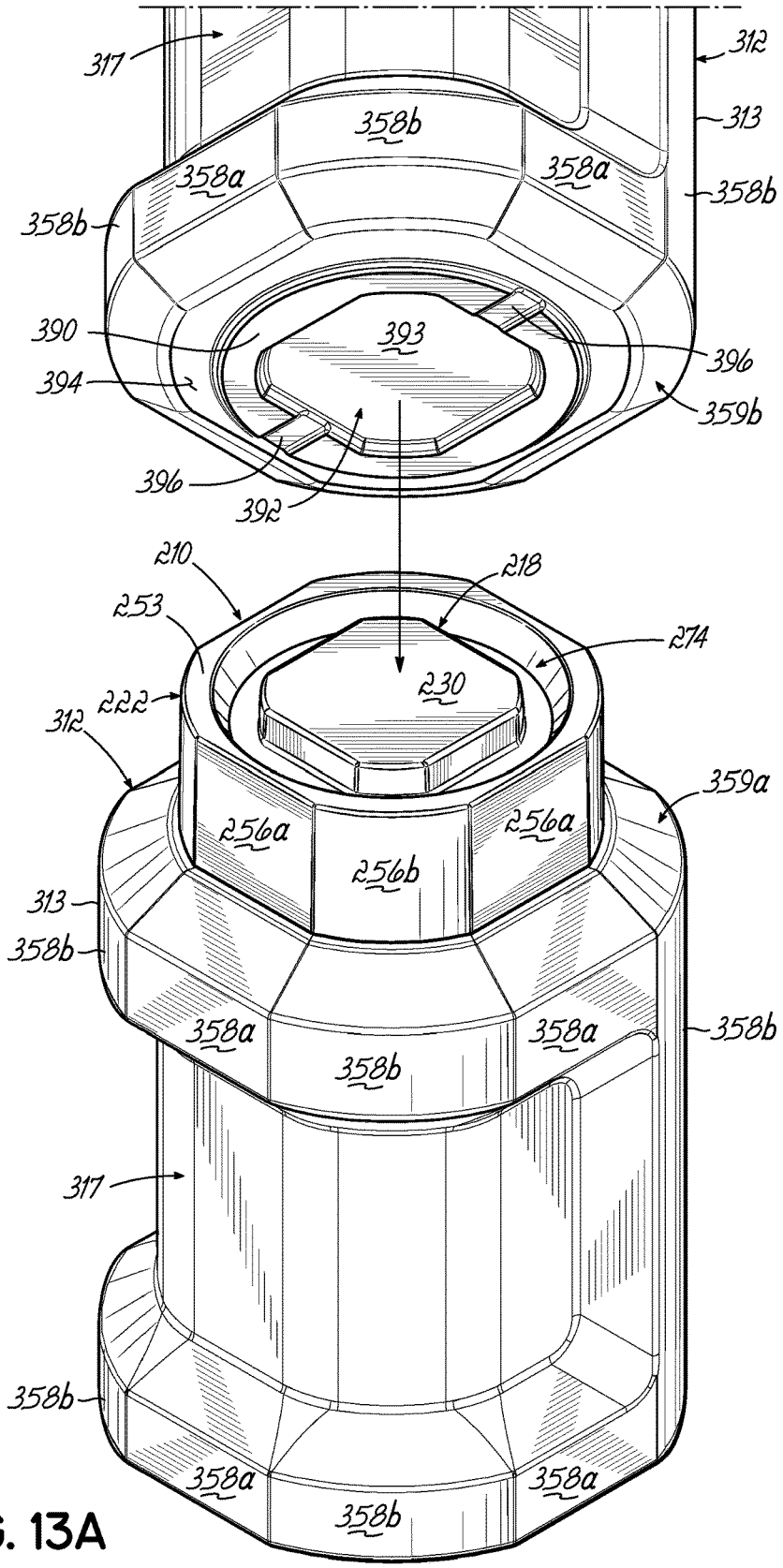
FIG. 13A is an isometric view showing an upper container of the embodiment of FIG. 12 being positioned for stacking on top of a closure assembly of a lower container of the embodiment of FIG. 12.
Figure 13B:
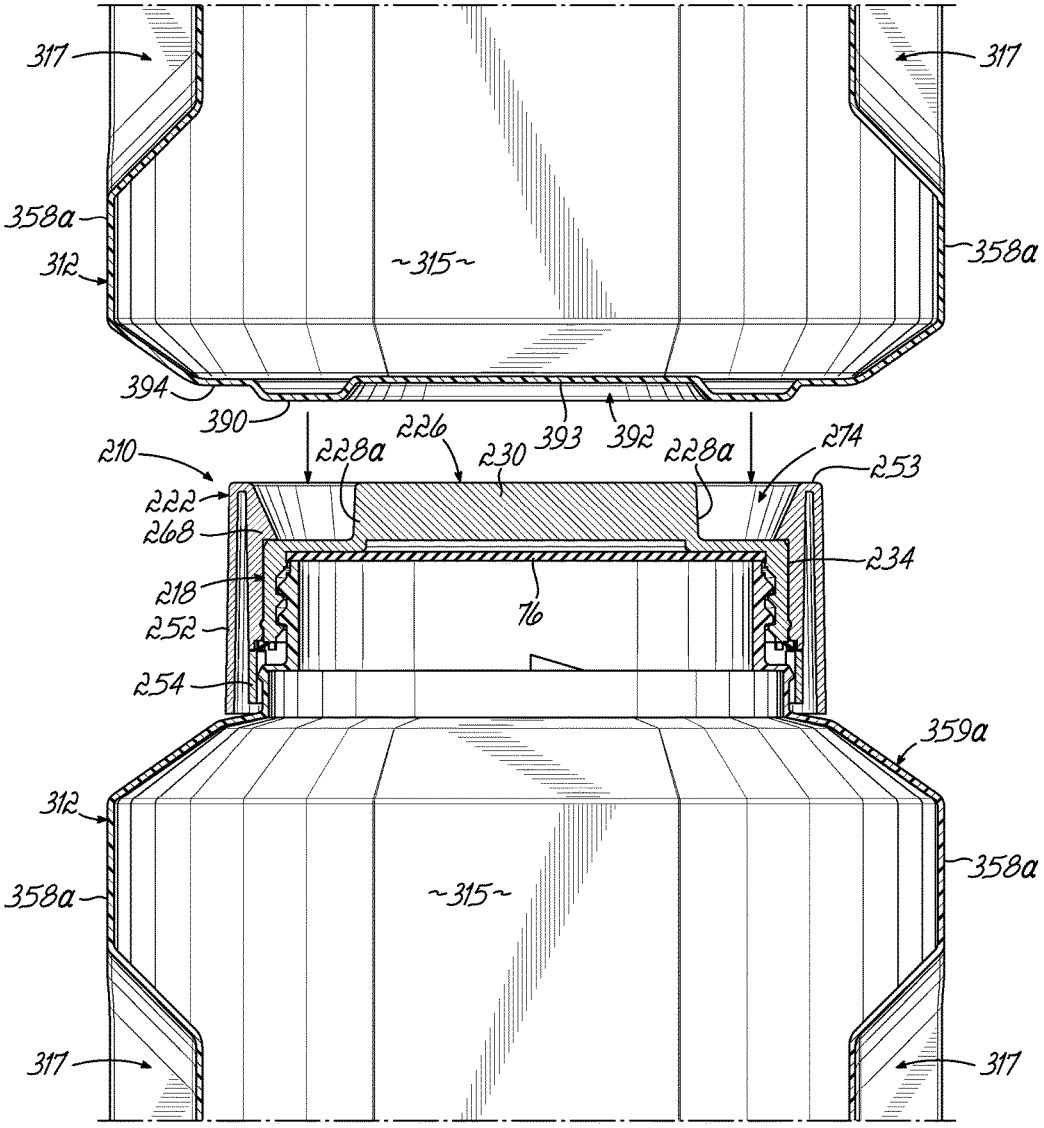
FIG. 13B is a side cross-sectional view taken generally along line 13-13 of FIG. 12, showing the upper container of FIG. 13A positioned for stacking on top of the closure assembly of the lower container of FIG. 13A.

Referring to FIGS. 12-13B, the closure assembly 210 is shown in connection with a container 312 in accordance with another exemplary embodiment of the present invention. The closure assembly 210 may be secured to the container 312 in a manner similar to that described above in connection with FIGS. 1-11C.

The container 312 includes a body 313 defining an inner cavity 315, and a neck 314 extending upwardly from the body 313 and defining a circular opening 316 that communicates with the inner cavity 315. The body 313 is similar in cross-sectional shape to the container bodies 13, 213 shown in FIGS. 1 and 8, and additionally includes a recessed handle 317 which may be gripped by the hand of a user. In the illustrated embodiment, the recessed handle 317 extends about at least half of the outer periphery of the container body 313 to provide a gripping surface for the user. The outer periphery of the body 313 may be formed with radial dimensions larger than corresponding radial dimensions of the containers 12, 212 of FIGS. 1 and 8. For example, the containers 12, 212 of FIGS. 1 and 8 may be sized to define internal volumes ranging from approximately 350 ml to approximately 1500 ml, while the container 312 may be sized to define an internal volume of at least approximately 2500 ml.

The container body 313 includes a plurality of generally planar side faces 358*a* interspaced by a plurality of generally curved side faces 358*b*. For example, the side faces 358*a*, 358*b* may be arranged to define a generally octagonal outer periphery of the container 312. The body 313 further includes an upper tapered portion 359*a* that extends from the upper ends of the side faces 358*a*, 358*b* in a direction toward the neck 314. As shown in FIG. 13A, the body 313 further includes a lower tapered portion 359*b* that extends from the lower ends of the side faces 358*a*, 358*b* in a direction toward the bottom end of the container 312. Each of the upper and lower tapered portions 359*a*, 359*b* includes a plurality of alternating planar and curved faces that correspond to respective planar and curved side faces 358*a*, 358*b*. As best shown in FIG. 13A, the closure assembly 210 may be secured to the container 312 such that the side faces 256*a*, 256*b* of the outer shell 222 align with the side faces 358*a*, 358*b* of the container 312. The outer periphery of the container 312 extends radially outward beyond the outer periphery of the closure assembly 210.

As shown in FIGS. 13A and 13B, the assembled tamper-evident closure assembly 210 and container 312 are stackable with one or more additional closure assemblies 210 and containers 312 in a manner similar to that described above in connection with FIGS. 11A-11C. In that regard, the bottom end of the container 312 includes features substantially similar to those on the bottom end of the container 212 shown in FIG. 11A. In particular, the container 312 includes a protruding bottom wall 390, a generally planar base surface 394 surrounding the bottom wall 390, a central cavity 392 formed in the bottom wall 390 and having a cavity base 393, and a pair of diametrically opposed channels 396. It will be understood that the general dimensions of the closure assembly 210 and the containers 212, 312 may be varied as desired, provided that the mating features of the closure assembly 210 and the containers 212, 312 are maintained in suitable proportion to enable the stacking ability described above.

Figure 14A:
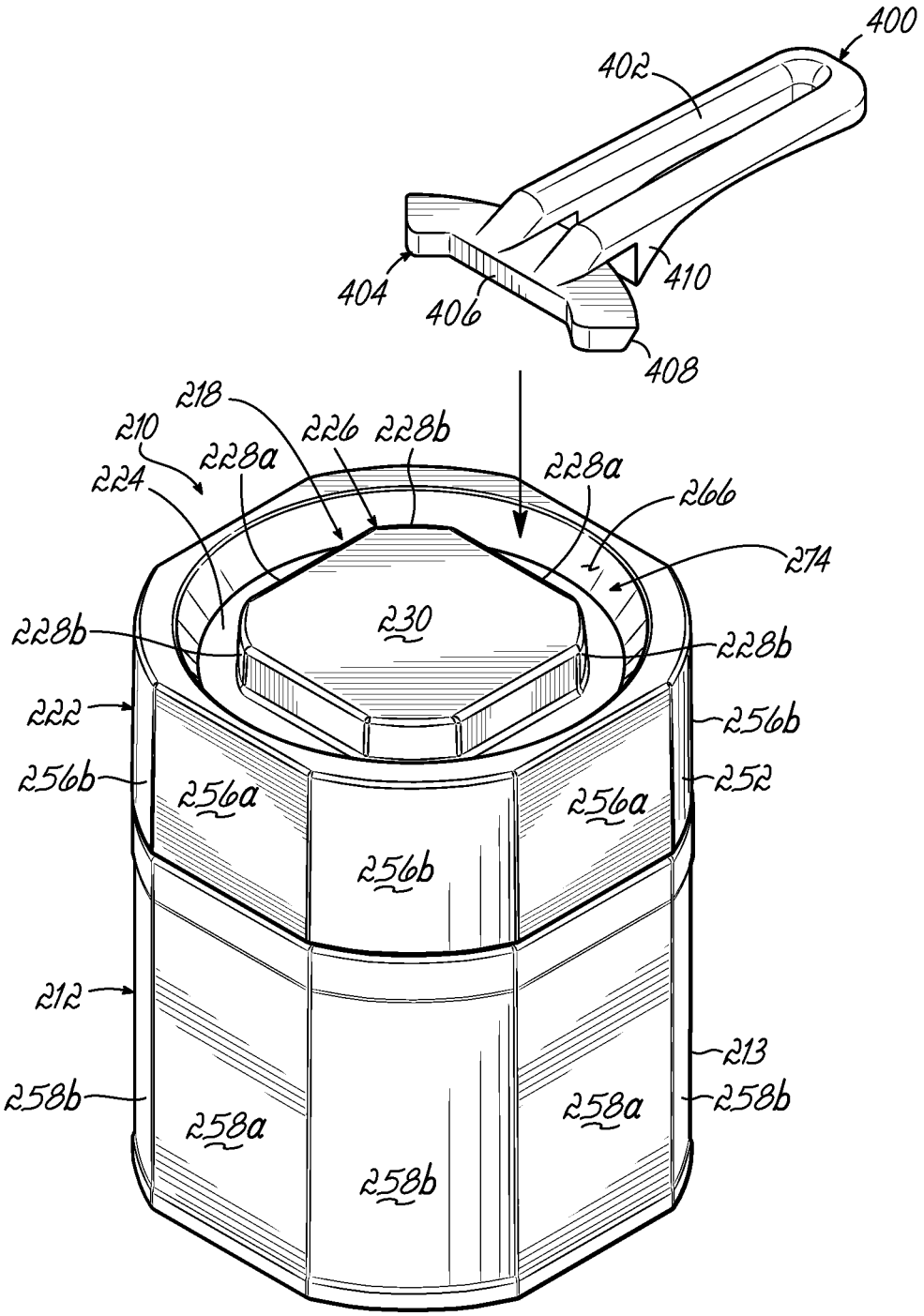
FIG. 14A is an isometric view showing a wrench for applying and/or removing a closure assembly from a container in accordance with the embodiments of the present invention.
Figure 14B:
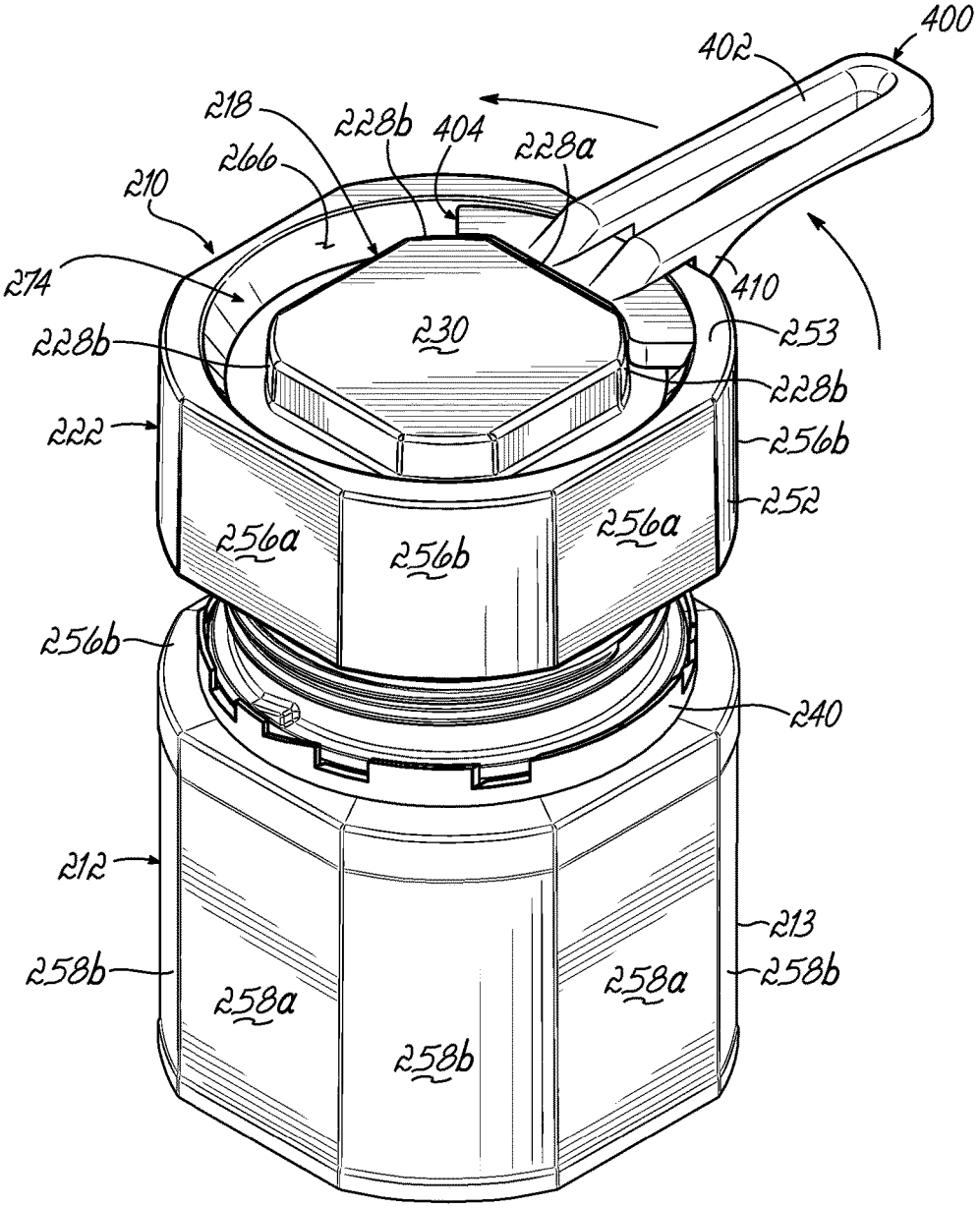
FIG. 14B is an isometric view showing removal of a closure assembly from its container using the wrench of FIG. 14A.

Referring to FIGS. 14A and 14B, an exemplary wrench 400 for attaching and removing a closure assembly from a container is shown. While the wrench 400 is shown and described herein in connection with closure assembly 210 and container 212, it will be appreciated that the wrench 400 may be similarly used in connection with any of the closure assemblies and containers described herein.

The wrench 400 generally includes a handle portion 402 and a gripping portion 404. The gripping portion 404 is shaped to be received within the annular cavity 274 of the closure assembly 210, and to engage the side faces 228*a*, 228*b* of the cap boss 226. For example, the gripping portion 404 may be generally C-shaped so that a distal face 406 of the gripping portion 404 may engage a planar side face 228*a* and its two adjacent curved side faces 228*b* of the cap boss 226. A proximal face 408 of the gripping portion 404 may be curved to engage the angled surface 266 of the outer shell 222. The wrench 400 may further include a flange 410 extending downwardly from the handle portion 402 for engaging the outer annular wall 252 of the outer shell 222 when the handle portion 402 confronts the upper wall 253. The wrench 400 may be of the type fully disclosed in U.S. patent application Ser. No. 14/199,669, filed Mar. 6, 2014, the disclosure of which is hereby incorporated by reference herein in its entirety.

As shown in FIG. 14B, the handle portion 402 functions as a moment arm, and may be gripped and rotated about the central axis of the container 212 and closure assembly 210 for threadedly engaging or disengaging, to tighten or loosen, the closure assembly 210 relative to the container 212. For example, the wrench 400 may be manipulated to rotate the closure assembly 210 counter-clockwise for loosening the closure assembly 210 from the container 212, or clockwise for tightening the closure assembly 210 onto the container 212.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A tamper-evident closure assembly for a container having an opening, the tamper-evident closure assembly comprising:

a cap configured to be secured to the container to cover the opening;

a tamper-evidencing member carried by the cap and configured to provide an indication when the cap is removed from the container; and an outer shell having a central aperture through which the cap is received, the outer shell and the cap being configured to cooperate with each other such that the cap is operatively secured to, and mounted so as to be non-rotatable relative to, the outer shell, wherein the cap includes a first plurality of circumferentially spaced planar faces and the outer shell includes a second plurality of circumferentially spaced planar faces that engage the first plurality of circumferentially spaced planar faces so as to prevent relative rotation between the outer shell and the cap.

2. The tamper-evident closure assembly of claim 1, wherein each of the circumferentially spaced planar faces on the cap includes one of an outwardly projecting rib or a groove, and the corresponding one of the circumferentially spaced planar faces on the outer shell includes the other of an outwardly projecting rib or a groove, and wherein each of the outwardly projecting ribs engages the corresponding groove so as to prevent relative rotation between the outer shell and the cap.

3. The tamper-evident closure assembly of claim 1, wherein the outer shell includes a first annular wall and a second annular wall joined with the first annular wall and disposed radially inward from the first annular wall, the second annular wall defining the central aperture and configured to engage the cap for removably securing the outer shell to the cap.

4. The tamper-evident closure assembly of claim 3, wherein the cap includes at least one outwardly projecting rib and the second annular wall includes at least one groove configured to receive the outwardly projecting rib for mounting the cap so as to be non-rotatable relative to the outer shell.

5. The tamper-evident closure assembly of claim 3, wherein the second annular wall includes at least one inwardly projecting finger and the cap includes at least one surface configured to engage the at least one finger of the outer shell to limit axial movement of the outer shell relative to the cap.

6. The tamper-evident closure assembly of claim 3, wherein the cap includes at least one outwardly projecting bead and the second annular wall includes at least one circumferentially extending groove configured to receive the at least one outwardly projecting bead for operatively securing the cap to the outer shell.

7. The tamper-evident closure assembly of claim 1, wherein a top portion of the cap protrudes from the central aperture of the outer shell and the tamper-evidencing member is peripherally surrounded by the outer shell.

8. The tamper-evident closure assembly of claim 1, wherein an uppermost surface of the cap and an uppermost surface the outer shell are substantially coplanar.

9. The tamper-evident closure assembly of claim 1, further comprising:

an ultrasonically welded bond between the cap and the outer shell.

10. A system for storing material, comprising:

a plurality of containers, each container including an opening and being fitted with a tamper-evident closure assembly including a cap secured with the container to cover the opening, a tamper-evidencing member carried by the cap and configured to provide an indication when the cap is removed from the container, and an outer shell having a central aperture through which the cap is received, the cap being operatively secured to, and mounted so as to be non-rotatable relative to, the outer shell;

wherein each of the circumferentially spaced planar faces on the cap includes one of an outwardly projecting rib or a groove, and the corresponding one of the circumferentially spaced planar faces on the outer shell includes the other of an outwardly projecting rib or a groove, and wherein each of the outwardly projecting ribs engages the corresponding groove so as to prevent relative rotation between the outer shell and the cap, and wherein each of the containers includes a bottom wall having a cavity, and the plurality of containers and their corresponding tamper-evident closure assemblies are configured to be stacked one on top of another such that a top portion of the cap secured to a lower one of the containers is received within the cavity on the bottom wall of an adjacent upper one of the containers.

11. The system of claim 10, wherein the outer shell of each of the tamper-evident closure assemblies includes an outer periphery corresponding substantially in size and shape with a maximum outer periphery of the respective container, and wherein the maximum outer periphery of each of the containers is substantially aligned with the outer periphery of the outer shell of the tamper-evident closure assembly fitted on an adjacent one of the containers.

* * * * *